US006159337A

United States Patent [19]

Marcoccia et al.

[11] Patent Number: 6,159,337

[45] **Date of Patent: *Dec. 12, 2000**

[54] DISSOLVED ORGANIC MATERIALS CONTROL IN CELLULOSE PULP PRODUCTION

[75] Inventors: Bruno S. Marcoccia, South Glens Falls; J. Robert Prough, Queensbury; Richard O. Laakso, Queensbury; Joseph R. Phillips, Queensbury, all of N.Y.; Rolf C. Ryham, Roswell, Ga.; Jan T. Richardsen, Glens Falls; R. Fred Chasse, Queensbury, both of N.Y.

[73] Assignee: Andritz-Ahlstrom Inc., Glens Falls, N.Y.

[ * ] Notice: This patent is subject to a terminal disclaimer.

[21] Appl. No.: 09/414,887

[22] Filed: Oct. 8, 1999

Related U.S. Application Data

[62] Division of application No. 09/175,467, Oct. 20, 1998, which is a division of application No. 08/775,197, Dec. 30, 1996, Pat. No. 5,849,150, which is a division of application No. 08/625,709, Apr. 3, 1996, Pat. No. 5,620,562, which is a division of application No. 08/127,548, Sep. 28, 1993, Pat. No. 5,547,012, which is a continuation-in-part of application No. 08/056,211, May 4, 1993, Pat. No. 5,489,363.

[51] Int. Cl.[7] ..... D21C 7/12; D21C 7/14

[52] U.S. Cl. ..... 162/42; 162/43; 162/61

[58] Field of Search ..... 162/16, 29, 42, 162/43, 249, 250, 61

[56] References Cited

U.S. PATENT DOCUMENTS

| | | | |
|---|---|---|---|
| 3,425,898 | 2/1969 | Laakso | 162/45 |
| 3,793,137 | 2/1974 | Backlund | 162/39 |
| 4,670,098 | 6/1987 | Thorsell et al. | 162/29 |
| 5,536,366 | 7/1996 | Marcoccia et al. | 162/43 |

FOREIGN PATENT DOCUMENTS 476230 5/1991 European Pat. Off. .

*Primary Examiner*—Dean T. Nguyen
*Attorney, Agent, or Firm*—Nixon and Vanderhye P.C.

[57] ABSTRACT

Kraft pulp of increased strength and bleachability may be produced with decreased consumption of effective alkali, and at a lower H factor, by keeping the dissolved organic material (DOM) concentration low substantially through the entire kraft cook, including by extracting high DOM liquid from at least one part of a continuous digester and replacing it wit much lower level DOM liquid. Existing pulp mills having two-vessel hydraulic, one-vessel hydraulic, or other systems may be retrofit to provide for extractions and additions of low DOM dilution liquor (including substantially DOM-free white liquor). Also, commercial size batch digesters (8 tons per day of pulp or more) can be operated with low DOM liquor to produce increased strength pulp. Using dilution with low DOM liquor also results in reduced H factor and effective alkali consumption, and increased bleachability.

19 Claims, 21 Drawing Sheets

FIG. 12A
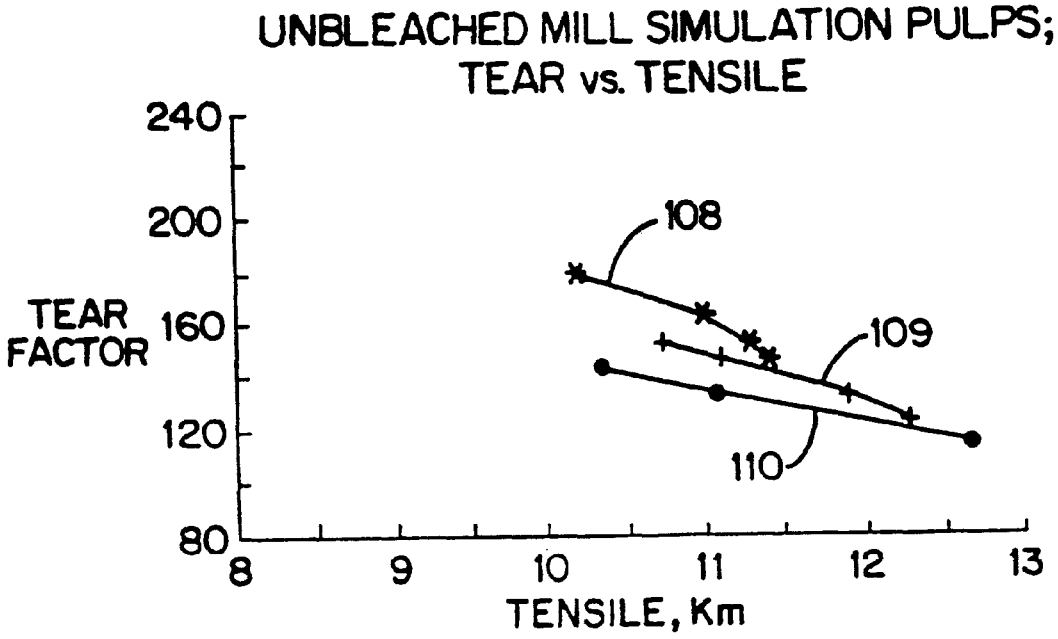
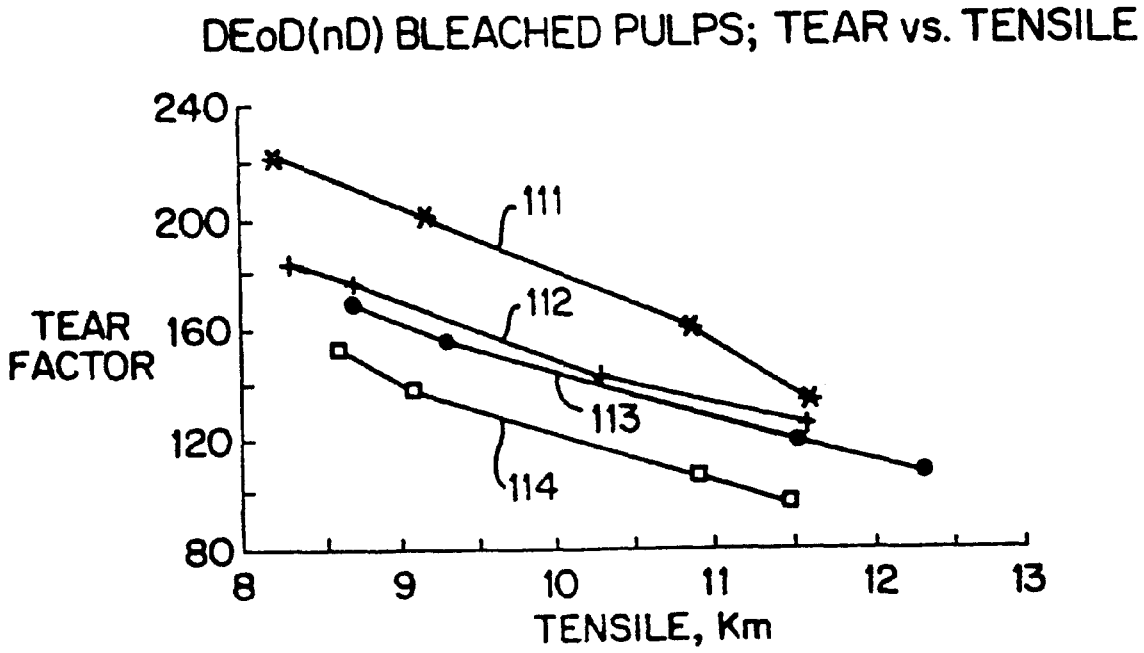
FIG. 12B

FIG. 13A
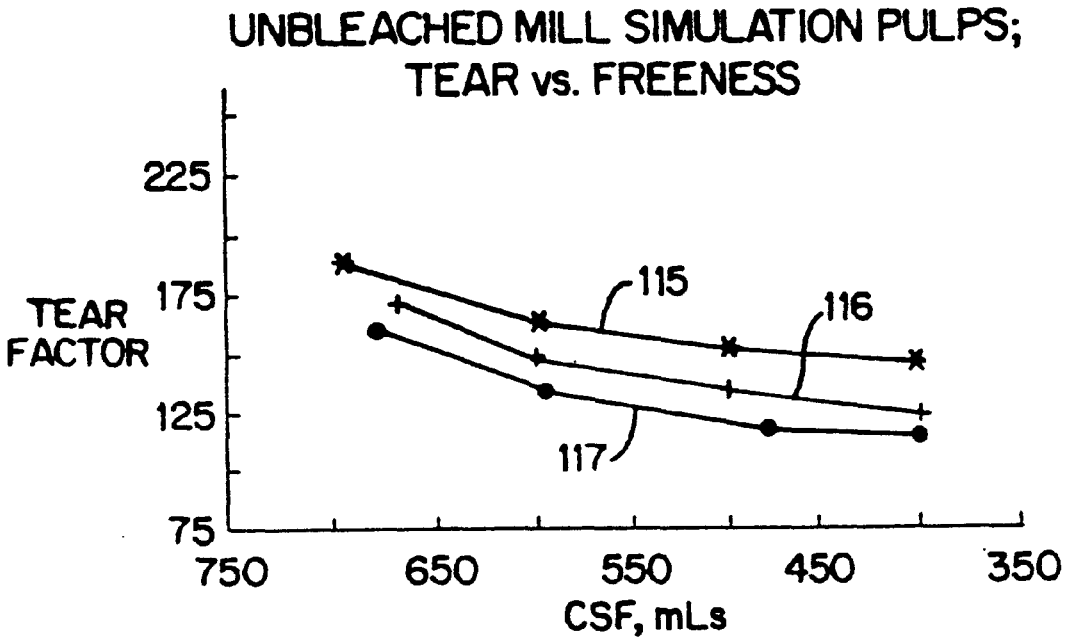
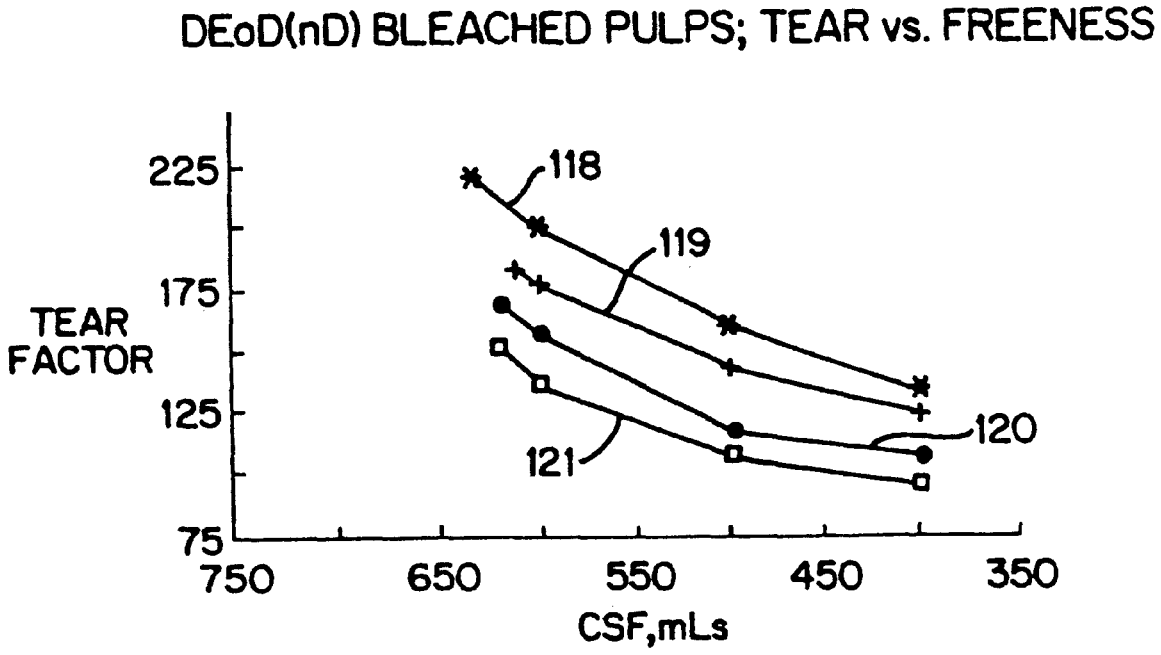
FIG. 13B

FIG. 14A
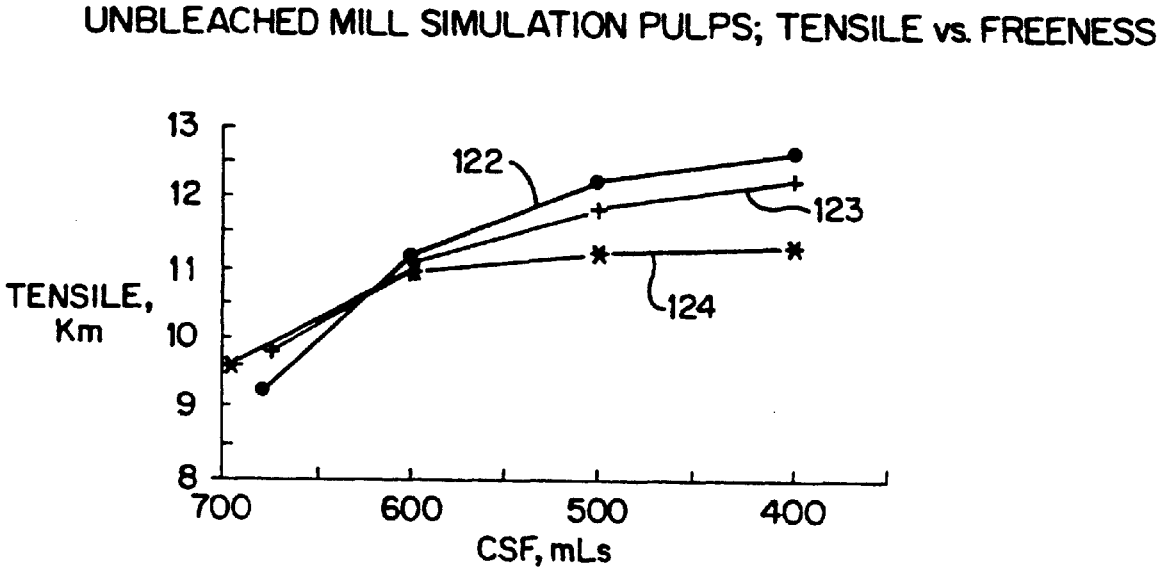
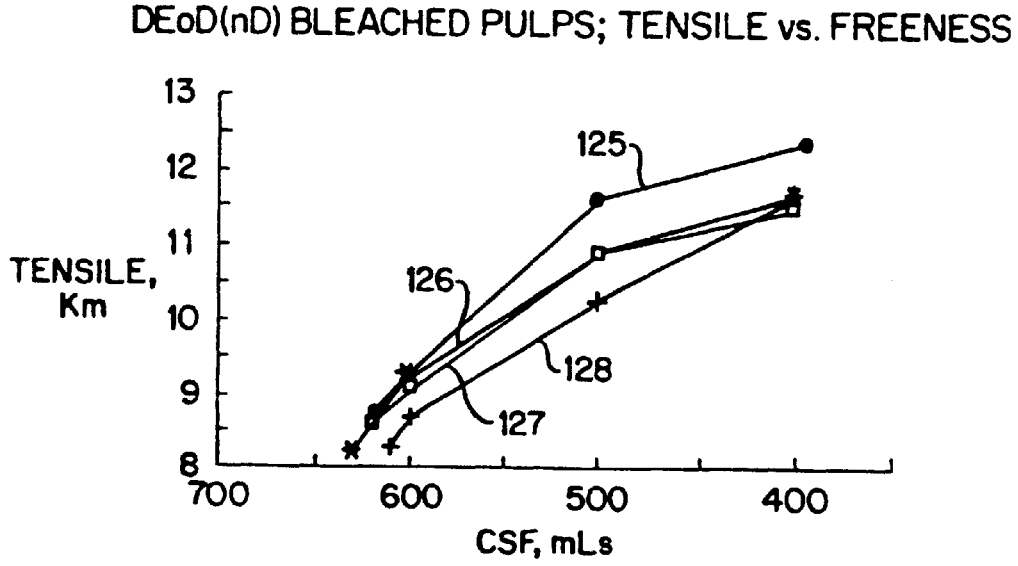
FIG. 14B

PREDICTED DOM CONCENTRATIONS: MCC® vs. MCC® w/MULTIPLE EXTRACTIONS/DILUTIONS
(EXTRACTION AND DILUTION AT MODIFIED COOKING SCREENS ONLY)

TOTAL ORGANIC SOLIDS (g/L)
140
120
100
80
60
40
20
0
1
2
3
4
5
TIME (hr)
168
169
170
171
EXTRACTION SCREENS
(140 IN FIG. 16)
MODIFIED COOKING SCREENS
(143 IN FIG. 16)

DSP via EXTRACTION/DILUTION at WE CIRCULATION
EFFECT OF VARYING THE DILUENT (CBF) SPLIT DSP via EXTRACTION/DILUTION at WE CIRCULATION
EFFECT OF VARYING EXTRACTION at WE SCREENS

DISSOLVED ORGANIC MATERIALS CONTROL IN CELLULOSE PULP PRODUCTION

CROSS REFERENCE TO RELATED APPLICATION

This is a divisional of application Ser. No. 09/175,467, filed Oct. 20, 1998, now pending, which in turn is a divisional of application Ser. No. 08/775,197, filed Dec. 30, 1996, now U.S. Pat. No. 5,849,150, which in turn is a divisional of Ser. No. 08/625,709, filed Apr. 3, 1996, now U.S. Pat. No. 5,620,562, which in turn is a divisional of Ser. No. 08/127,548, filed Sep. 28, 1993, now U.S. Pat. No. 5,547,012, which in turn is a continuation-in-part of Ser. No. 08/056,211, filed May 4, 1993, now U.S. Pat. No. 5,489,363, the entire content of which is hereby incorporated by reference in this application.

BACKGROUND AND SUMMARY OF THE INVENTION

According to conventional knowledge in the art of kraft pulping of cellulose, the level of dissolved organic materials (DOM)—which mainly comprise dissolved hemi-cellulose, and lignin, but also dissolved cellulose, extractives, and other materials extracted from wood by the cooking process—is known to have a detrimental affect in the later stages of the cooking process by impeding the delignification process due to consumption of active cooking chemical in the liquor before it can react with the residual or native lignin in wood. The effect of DOM concentration at other parts of cooking, besides the later stages, is according to conventional knowledge believed insignificant. The impeding action of DOM during the later stages of the cook is minimized in some state-of-the-art continuous cooking processes, particularly utilizing an EMCC® digester from Kamyr, Inc. of Glens Falls, N.Y., since the counter-current flow of liquor (including white liquor) at the end of the cook reduces the concentration of DOM both at the end of the "bulk delignification" phase, and throughout the so-called "residual delignification" phase.

According to the present invention, it has been found that not only does DOM have an adverse affect on cooking at the end of the cooking phase, but that the presence of DOM adversely affects the strength of the pulp produced during any part of the cooking process, that is at the beginning, middle, or end of the bulk delignification state. The mechanism by which DOM affects pulp fibers and thereby adversely affects pulp strength has not been positively identified, but it is hypothesized that it is due to a reduced mass transfer rate of alkali extractable organics through fiber walls induced by DOM surrounding the fibers, and differential extactability of crystalline regions in the fibers compared to amorphous regions (i.e. nodes). In many event, it has been demonstrated according to the invention that if the DOM level (concentration) is minimized throughout the cook, pulp strength is increased significantly.

It has been found, according to the present invention, that if the level of DOM is close to zero throughout a kraft cook, tear strength of the pulp is greatly increased i.e. increased up to about 25% (e.g. 27%) at 11 km tensile compared to conventionally produced kraft pulp. Even reductions of the DOM level to one-half or one-quarter of their normal levels also significantly increase pulp strength.

In state-of-the-art kraft cooks, it is not unusual for the DOM concentration at some points during the kraft cook to be 130 grams per liter (g/l) or more, and at 100 g/l or more at numerous points during the kraft cook (for example in the bottom circulation, rim circulation, upper and main extractions and MC circulation in Kamyr, Inc. MCC® continuous digesters), even if the DOM level is maintained between about 30–90 g/l in the wash circulation (at later cook stages, according to conventional wisdom). In such conventional situations it is also not unusual for the lignin component of the DOM level to be over 60 g/l and in fact even over 100 g/l, and for the hemi-cellulose component of the DOM level to be well over 20 g/l. It is not known if the dissolved hemi-cellulose component has a stronger adverse affect on pulp strength (e.g. by adversely affecting mass transfer of organics out of the fibers) than lignin, or vice versa, or if the effect is synergistic, although the dissolved hemi-celluloses are suspected to have a significant influence.

According to the present invention it has been recognized for the first time that the DOM concentration throughout a kraft cook should be minimized in order to positively affect bleachability of the pulp, reduce chemical consumption, and perhaps most significantly increase pulp strength. By minimizing DOM levels, one may be able to design smaller continuous digesters while obtaining the same throughput, and may be able to obtain some benefits of continuous digesters with batch systems. A number of these beneficial results can be anticipated by keeping the DOM concentration at 100 g/l or less throughout substantially the entire kraft cook (i.e., beginning, middle and end of bulk delignification), and preferably about 50 g/l or less (the closer to zero DOM one goes, the ore positive the results). It is particularly desirable to keep the lignin component at 50 g/l or less (preferably about 25 g/l or less), and the hemi-cellulose level at 15 g/l or less (preferably about 10 g/l or less).

According to the present invention it has also been found that it is possible to passivate the adverse affects on pulp strength of the DOM concentration, at least to a large extend. According to this aspect of the invention it has been found that if black liquor is removed and subjected to pressure heat treatment according to U.S. Pat. No. 4,929,307 (the disclosure of which is hereby incorporated by reference herein), e.g. at a temperature of about 170–350° C. (preferably 240° C.) for about 5–90 minutes (preferably about 30–60 minutes) and then reintroduced, an increase in tear strength of up to about 15% can be effected. The mechanism of which passivation of the DOM by heat treatment occurs also is not fully understood, but is consistent with the hypothesis described above, and its results are real and dramatic on pulp strength.

According to the present invention various methods are provided for increasing kraft pulp strength taking into account the adverse affects of DOM thereon, as set forth above, for both continuous and batch systems. Also according to the present invention increased strength kraft pulp is also provided, as well as apparatus for achieving the desired results according to the invention. Further, according to the invention, the H factor can be significantly reduced, e.g., at least about a 5% drop in H factor to achieve a given Kappa number. Also, the amount of effective alkali consumed can be significantly reduced, e.g., by at least about 0.5% on wood (e.g. about 4%) to achieve a particular Kappa number. Still further enhanced bleachability can be achieved, for example, increasing ISO brightness at least one unit at a particular full sequence Kappa factor.

According to one aspect of the present invention, a method of producing kraft pulp by cooking comminuted cellulosic fibrous material is provided. The method comprises the steps of continuously, at a plurality of different stages during kraft cooking of the material to produce pulp: (a) Extracting liquor containing a level of DOM substantial enough to adversely affect pulp strength. And, (b) replacing some or all of the extracted liquor with liquor containing a substantially lower effective DOM level than the extracted liquor, so as to positively affect pulp strength. Step (b) is typically practiced by replacing the withdrawn liquor with liquor selected from the group consisting essentially of water, substantially DOM free white liquor, pressure-heat treated black liquor, washer filtrate, cold blow filtrate, and combinations thereof. For example for at least one stage during cooking, black liquor may be withdrawn, and treated under pressure and temperature conditions (e.g. superatmospheric pressure at a temperature of about 170–350° C. for about 5–90 minutes, and at lest 20° C. over the cooking temperature) to significantly passivate the adverse affects of DOM. The term "effective DOM" as used in the specification and claims means that portion of the DOM that affects the pulp strength, H factor, effective alkali consumption and/or bleachability. A low effective DOM may be obtained by passivation (except for effect on bleachability), or by an originally low DOM concentration.

The method according to the invention can be practiced in a continuous vertical digester, in which case steps (a) and (b) may be practiced at at least two different levels of the digester. There is also typically the further step (c) of heating the replacement liquor from step (b) to substantially the same temperature as the withdrawn liquor prior to the replacement liquor being introduced into contact with the material being cooked. Steps (a) and (b) can be practiced during impregnation, near the start of the cook, during the middle of the cook, and near the end of the cook, i.e., during substantially the entire bulk delignification stage.

According to another aspect of the present invention, a method of kraft cooking is provided comprising the steps of, near the beginning of the kraft cook: (a) Extracting liquor containing a level of DOM substantial enough to adversely affect pulp strength. And, (b) replacing some or all of the extracted liquor with liquor containing a substantially lower effective DOM level than the extracted liquor, so as to positively affect pulp strength.

According to another aspect of the present invention a method of kraft cooking is provided comprising the steps of, during impregnation of cellulosic fibrous material: (a) Extracting liquor containing a level of DOM substantial enough to adversely affect pulp strength. And, (b) replacing some or all of the extracted liquor with liquor containing a substantially lower effective DOM level than the extracted liquor, so as to positively affect pulp strength.

According to still another aspect of the present invention a method of kraft cooking pulp is provided comprising the following steps: (a) Extracting black liquor from contact with the pulp at a given cooking stage. (b) Pressure-heating the black liquor to a temperature sufficient to significantly passivate the adverse effects on pulp strength of DOM therein. And, (c) re-introducing the passivated-DOM black liquor back into contact with the pulp at the given stage.

The invention also comprises the kraft pulp produced by the methods set forth above. This kraft pulp is different than kraft pulps previously produced, having a tear strength as much as 25% greater at a specified tensile for fully refined pulp (e.g. at 9 km tensile, or at 11 km tensile) (and at least about 15% greater) compared to kraft pulp produced under identical conditions without the DOM maintenance or removal steps according to the invention, or as much as 15% greater (e.g. at least about 10% greater) where passified black liquor is utilized.

The invention is also applicable to kraft batch cooking of cellulosic fibrous material utilizing a vessel containing black liquor and a batch digester containing the material. In such a method of kraft batch cooking according to the invention there are the steps of: (a) Pressure-heating the black liquor in the vessel to a temperature sufficient to passivate the adverse effects on pulp strength of DOM therein. And, (b) feeding the black liquor to the digester to contact the cellulosic fibrous material therein. Step (a) is practiced to heat the black liquor at superatmospheric pressure at a temperature of about 170–350° C. for about 5–90 minutes (typically at least about 190° C. for about 30–60 minutes, and at least 20° C. over cooking temperature), and step (b) may be practiced to simultaneously feed black liquor and white liquor to the digester to effect cooking of the cellulosic fibrous material.

According to another aspect of the present invention an apparatus for kraft cooking cellulose pulp is provided. The apparatus comprises the following elements. An upright continuous digester. At least two withdrawal/extraction screens provided at different levels, and different cook stages of the digester. A recirculation line and an extraction line associated with each of the screens. And, means for providing replacement liquor to the recirculation line to make up for the liquor extraction line, for each of the recirculation line. Each recirculatory loop typically includes a heater, and the digester may be associated with a separate impregnation vessel in which removal of high DOM concentration liquor and replacement with lower DOM concentration liquor also takes place (including in a return line communicating between the top of the impregnation vessel and the high pressure feeder).

The invention also relates to a commercial method of kraft cooking comminuted cellulose fibrous material by the step (a) of continuously passing substantially DOM-free cooking liquor into and out of contact with the material until completion of the kraft cook thereof, at a rate of at least 100 tons of pulp per day. This method is preferably practiced utilizing a batch digester having a capacity of at least 8 tons/day (e.g. 8–20), and by the further step (b), prior to step (a), of filling the digester with cellulose material, and the further step (c), after step (a) of discharging kraft pulp from the digester. The invention also relates to a batch digester system for practicing this aspect of the invention, each batch digester having a capacity of at least 8 tons per day (i.e. of commercial size as compared to laboratory size).

The invention also relates to a modification of a number of different types of continuous digesters, conventional MCC®Kamyr, Inc. digesters or EMCC®Kamyr, Inc. digesters, to achieve significant dilution of the effective DOM of the cooking liquor during at lest one early or intermediate stage of the cook. By arranging the extraction and recirculation screens in a particular way, the advantageous results according to the invention can be achieved in existing digesters merely by re-routing various fluid flows and introducing low DOM dilution liquor and/or white liquor at various points, in all conventional types of continuous digesters including single vessel hydraulic, two vessel hydraulic, etc.

It is the primary object of the invention to produce increased strength kraft pulp, and/or also typically reducing H factor and alkali consumption, and increasing bleachability. This and other objects of the invention will become clear from an inspection of the detailed description of the invention and from the appended claims.

BRIEF DESCRIPTION OF THE DRAWINGS

FIGS. 10 through 14B are further graphical representations of various strength aspects of pulp produced according to the present invention, in FIGS. 12A–B being compared with kraft pulp produced under identical conditions only not practicing the invention;

DETAILED DESCRIPTION OF THE DRAWINGS

Figure 1:
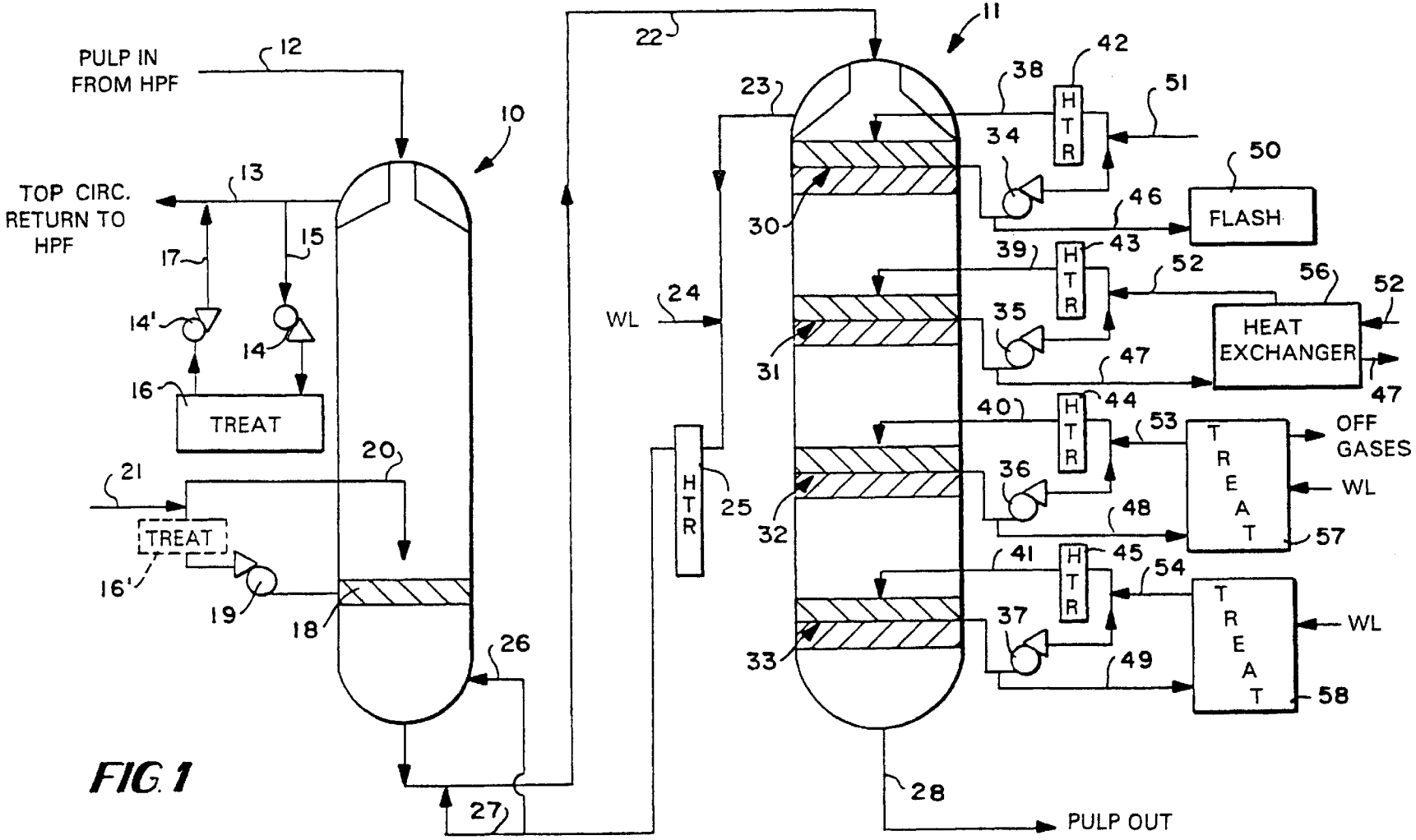
FIG. 1 is a schematic illustration of one exemplary embodiment of continuous kraft cooking equipment according to the invention, for practicing exemplary methods according to the present invention.

FIG. 1 illustrates a two vessel hydraulic kraft digester system, such as that sold by Kamyr, Inc. of Glens Falls, N.Y. modified to practice exemplary methods according to the present invention. Of course any other existing continuous digester systems also can be modified to practice the invention, including single vessel hydraulic, single vessel vapor phase, and double vessel vapor phase digesters.

In the exemplary embodiment illustrated in FIG. 1, a conventional impregnation vessel (IV) 10 is connected to a conventional vertical continuous digester 11. Comminuted cellulosic fibrous material entrained in water and cooking liquor is transported from a conventional high pressure feeder via line 12 to the top of the IV 10, and some of the liquor is withdrawn in line 13 as is conventional and returned to the high pressure feeder. According to the present invention, in order to reduce the concentration of DOM (as used in this specification and claims, dissolved organic materials, primarily dissolved hemi-cellulose and lignin, but also dissolved cellulose, extractives, and other materials extracted from wood by the kraft cooking process) liquor is withdrawn by pump 14 in line 15 (or from the top of vessel 10) and treated at stage 16 to remove or passivate DOM, or selected constituents thereof. The stage 16 may be a precipitation stage (e.g. by lowering pH below 9), an absorption stage (e.g. a cellulose fiber column, or activated carbon), or devices for practicing filtration (e.g. ultrafiltration, microfiltration, nanofiltration, etc.) solvent extraction, destruction (e.g. by bombardment with radiation), supercritical extraction, gravity separation, or evaporation (followed by condensation).

Replacement liquor (e.g. after stage 16) may or may not be is added to the line 13 by pump 14 in line 17, depending upon whether impregnation is practiced co-currently or counter-currently. The replacement liquor added in line 17, instead of extracted liquor treated in stage 16, may be dilution liquor, e.g. fresh (i.e. substantially DOM-free) white liquor, water, washer filtrate (e.g. brownstock washer filtrate), cold blow filtrate, or combinations thereof.

If it is desired to enhance the sulfidity of the liquor being circulated in the lines 12, 13, black liquor may be added in line 17, but the black liquor must be treated so as to effect passivation of the DOM therein, as will be described hereafter.

In any event, the liquor withdrawn at 15 has a relatively high DOM concentration, while that added in 17 has a much lower effective DOM level, so that pulp strength is positively affected. conduit 20. To the liquid recirculated in conduit 20 is added—as indicated by line 21—dilution liquid, to dilute the concentration of the DOM. Also the dilution liquid includes at least some white liquor. That is the liquor reintroduced in conduit 20 will have a substantially lower effective DOM level than the liquor withdrawn through the screen 18, and will include at least some white liquor. A treatment stage 16'—like stage 16—also may be provided in conduit 20 as shown in dotted line in FIG. 1.

From the bottom of the IV 10, the slurry of comminuted cellulosic fibrous material passes through line 22 to the top of the digester 11, and as is known, some of the liquid of the slurry is withdrawn in line 23, white liquor is added thereto at 24, and passes through a heater (typically an indirect heater) 25, and then is reintroduced to the bottom of the IV 10 via line 26 and/or introduced close to the start of the conduit 22 as indicated at 27 in FIG. 1.

In existing continuous digesters, usually liquid is withdrawn at various levels of the digester, heated, and then reintroduced at the same level as withdrawn, however under normal circumstances liquor is not extracted from the system and replaced with fresh reduced-DOM liquor. In existing continuous digester, black liquor is extracted at a central location in the digester, and the black liquor is not reintroduced, but rather it is sent to flash tanks, and then ultimately passed to a recovery boiler or the like. In contradistinction to existing continuous digester, the continuous digester 11 according to the present invention actually extracts liquor at a number of different stages and heights and replaces the extracted liquor with liquor having a lower DOM concentration. This is done near the beginning of the cook, in the middle of the cook, and near the end of the cook. By utilizing the digester 11 illustrated in FIG. 1, and practicing the method according to the invention, the pulp discharged in line 28 has increased strength compared to conventional kraft discharged in line 28 has increased strength compared to conventional kraft pulp treated under otherwise identical conditions in an existing continuous digester.

The digester 11 includes a first set of withdrawal screens 30 adjacent the top thereof, near the beginning of the cook, a second set of screens 31 near the middle of the cook and third and fourth sets of screens 32, 33 near the end of the clock. The screens 30–33 are connected to pumps 34–37, respectively, which pass through recirculation lines 38–41, respectively, optionally including heaters 42–45, respectively, these recirculation loops per se being conventional. However according to the present invention part of the withdrawn liquid is extracted, in the lines 46–49, respectively, as by passing the line 46 to a series of flash tanks 50, as shown in association with the first set of screens 30 in FIG. 1.

To make up for the extracted liquor, which has a relatively high DOM concentration, and to lower the DOM level, replacement (dilution) liquor is added, as indicated by lines 51 through 54, respectively, the liquor added in the lines 51 through 54 having a significantly lower effective DOM concentration than the liquor extracted in lines 46–49, so as to positively affect pulp strength. The liquor added in lines 51 through 54 may be the same as the dilution liquors described above with respect to line 17. The heaters 42–45 heat the replacement liquor, as well as any recirculated liquor, to substantially the same temperature as (typically slightly above) the withdrawn liquor.

Any number of screens 30–33 may be provided in digester 11.

Prior to transporting he extracted liquor to a remote site and replacing it with replacement liquor, the extracted liquor and the replacement liquor can be passed into heat exchange relationship with each other, as indicated schematically by reference number 546 in FIG. 1. Further, the extracted liquor can be treated to remove or passify the DOM therein, and then be immediately reintroduced as the replacement liquor (with other, dilution, liquor added thereto if desired). This is schematically illustrated by reference numeral 57 in FIG. 1 wherein the extracted liquor in line 48 is treated at station 57 (like stage 16) to remove DOM, and then reintroduced at 53. White liquor is also added thereto as indicated in FIG. 1, as a matter of fact at each of the stages associated with the screens 30–33 in FIG. 1 white liquor can be added (to lines 51–54, respectively).

Another option for the treatment block 57—schematically illustrated in FIG. 1—is black liquor pressure heating. From the screens 32 liquor that may be considered "black liquor"is withdrawn, and a portion extracted in line 48. The pressure heating in stage 57 may take place according to U.S. Pat. No. 4,929,307, the disclosure of which is hereby incorporated by reference herein. Typically, in stage 57 the black liquor would be heated to between about 170–350° C. (preferably above 190° C., e.g. at about 240° C.) at superatmospheric pressure for about 5–90 minutes (preferably about 30≧60 minutes), at least 20° C. over cooking temperature. This results in signification passivation of the DOM, and the black liquor may then be returned as indicated by line 53.

The treatment stage illustrated schematically at 58 in FIG. 1, associated with the last set of withdrawal/extraction screens 33, is like stage 16. A stage like 58 may be provided, or omitted, at any level of the digester 11 where there is extraction instead of adding dilution liquor. White liquor may be added at 58 too, and then the now DOW-depleted liquor is returned in line 54.

Whether treated extracted liquor or dilution liquor is utilized, according to the invention it is desirable to keep the total DOM concentration of the cooking liquor at 100 g/l or below during substantially the entire kraft cook (bulk delignification), preferably below about 50 g/l; and also to keep the lignin concentration at 50 g/l or below (preferably about 25 g/l or less), and the hemi-cellulose concentration at 15 g/l or less (preferably about 10 g/l or below). The exact commercially optimum concentration is not yet known, and may differ depending upon wood species being cooked.

Figure 3:
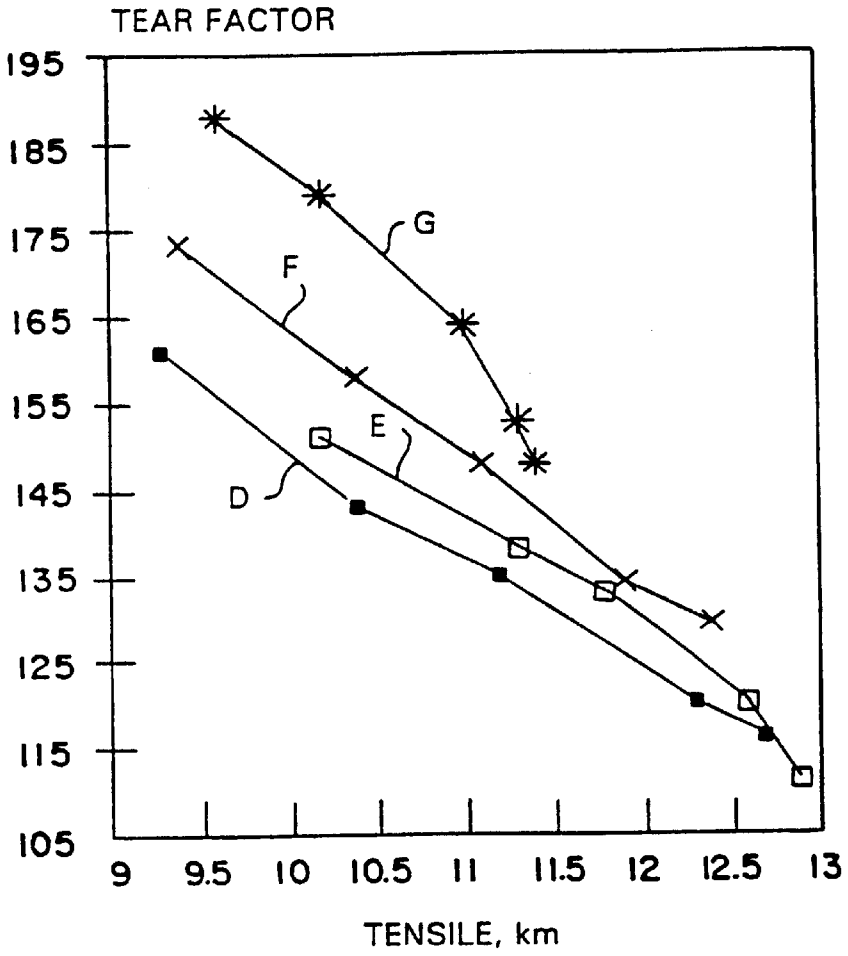
FIGS. 2 and 3 are graphical representations of the strength of pulp produced according to the present invention compared with kraft pulp produced under identical conditions only not practicing the invention.
Figure 2:
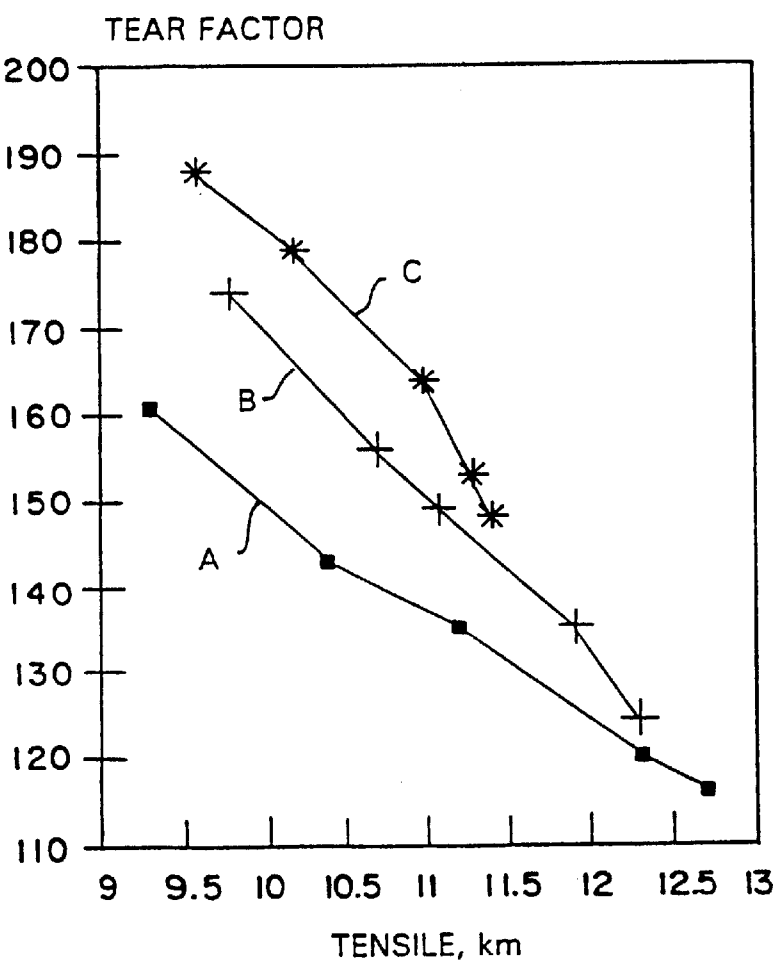

FIGS. 2 and 3 illustrate the results of actual laborator testing pursuant to the present invention. FIG. 2 shows tear-tensile curves for three different laboratory kraft cooks all prepared from the same wood furnish. The tear factor is a measure of the inherent fiber and pulp strength.

In FIG. 2 curve A is pulp prepared utilizing conventional pulp mill liquor samples (from an MCC® commercial full scale pulping process) as the cooking liquor. Curve B is obtained from a cook where the cooking liquor is the same as in curve A except that the liquor samples were heated at about 190° C. for one hour, at superatmospheric pressure, prior to use in the cook. Curve C is a cook which used synthetic white liquor as the cooking liquor, which synthetic white liquor was essentially DOM-free, (i.e. less than 50 g/l). The cooks for curves A and B were performed such that the alkali, temperature (about 160° C.), and DOM profiles were identical to those of the full-scale pulping process from which the liquor samples were obtained. For curve C the alkali and temperature profiles were identical to those in curves A and B, but no DOM was present.

FIG. 2 clearly illustrates that as a result of low DOM liquor contacting the chips during the entire kraft cook, there is approximately a 27% increase in tear strength at 11 km tensile. Passivation of the DOM utilizing pressure heating of black liquor, pursuant to curve B according to the invention, also resulted in a substantial strength increase compared to the standard curve A, in this case approximately a 5% increase in tear strength at 11 km tensile.

FIG. 3 illustrates further laboratory work comparing conventional kraft cooks with cooks according to the invention. The cooks represented by curves D through G were prepared utilizing identical alkali and temperature profiles, for the same wood furnish, but with varying concentrations of DOM for the entire kraft cook. The DOM concentration for curve D, which was a standard MCC® kraft cook (mil liquor) was the highest, and the DOM concentration for curve G was the lowest (essentially DOM-free). The DOM concentration for curve E was about 25% lower than the DOM concentration for curve D, while the DOM concentration for curve F was about 50% lower than the DOM concentration for curve D. As can be seen, there was a substantial increase in tear strength inversely proportional to the amount of DOM present during the complete cook.

Cooking according to the invention is preferably practiced to achieve a pulp strength (e.g. tear strength at a specified tensile for fully refined pulp, e.g. 9 to 11 km) increase of at least about 10% and preferably at least about 15%, compared to otherwise identical conditions but where DOM is not specially handled.

While with respect to FIG. 1 the invention was described primarily with respect to continuous kraft cooking, the principles according to the invention are also applicable to batch kraft cooking.

Figure 4:
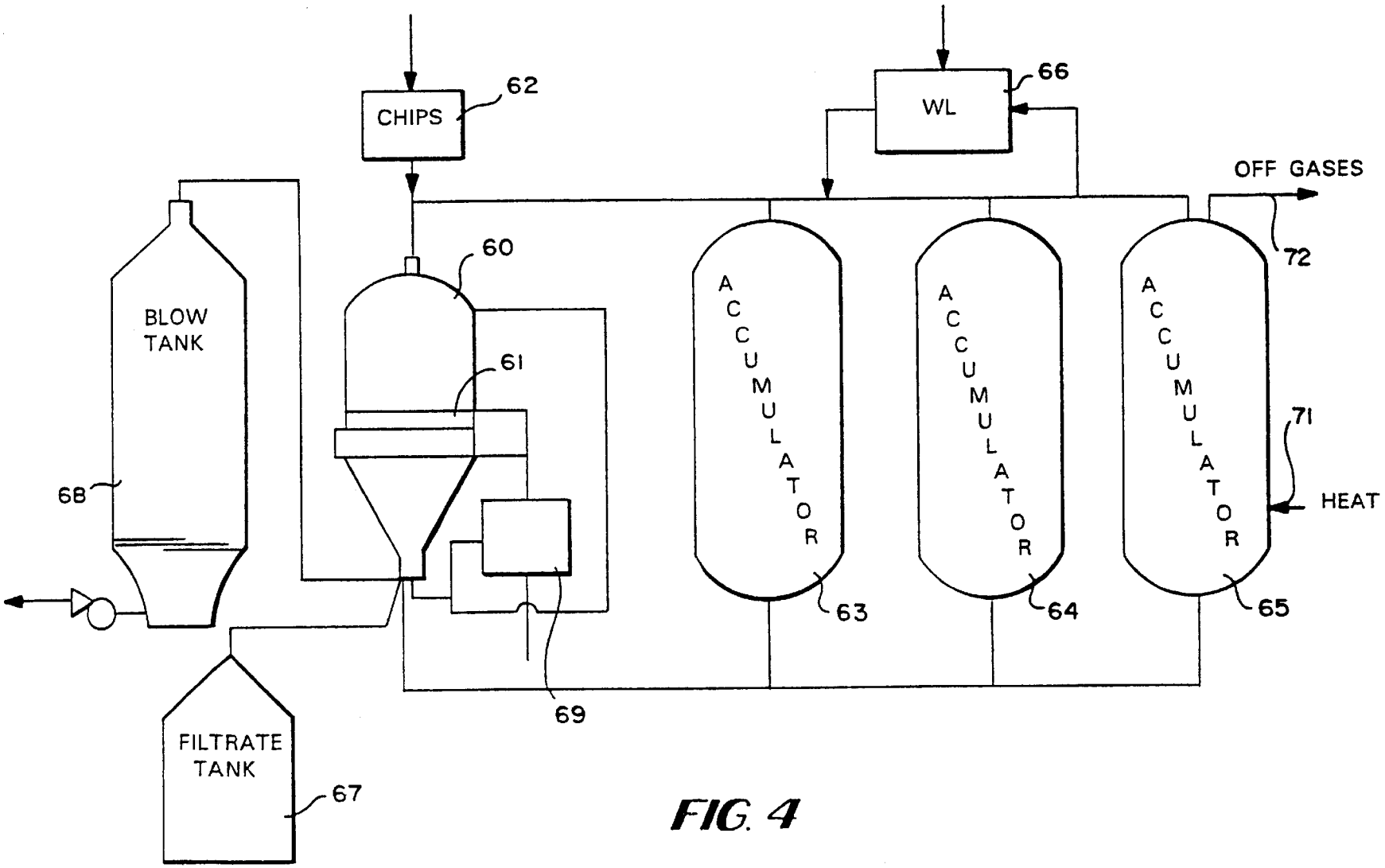
FIG. 4 is a schematic view of exemplary equipment for the improved method of batch draft cooking according to the invention.

FIG. 4 schematically illustrates conventional equipment that may be used in the practice of the Beloit RDH™ batch cooking process, or for the Sunds Super Batch™ process.

The system is illustrated schematically in FIG. 4 includes a batch digester 60 having withdrawal screen 61, a source or chips 62, first, second and third accumulators 63, 64, 65, respectively, a source of white liquor 66, a filtrate tank 67, a blow tank 68, and a number of valving mechanisms, the primary valving mechanism illustrated schematically at 69.

In a typical conventional operating cycle for the Beloit RDH™ process, the digester 60 is filled with chips from source 62 and steamed as required. Warm black liquor is then fed to the digester 60. The warm black liquor typically has high sulfidity and low alkalinity, and a temperature of about 110–125° C., and is provided by one of the accumulators (e.g. 63). Any excess warm black liquor may pass to a liquor tank and ultimately to evaporators, and then to be passed to chemical recovery. After impregnation, the warm black liquor in digester 60 is returned to accumulator 63, and then the digester 60 is filled with hot black and white liquor. The hot black liquor may be from accumulator 65, and the hot white liquor from accumulator 63, ultimately from source 66. Typically the white liquor is at a temperature of about 155° C., while the hot black liquor is at a temperature of about 150–165° C. The chips in the digester 60 are then cooked for the predetermined time at temperature to achieve the desired H factor, and then the hot liquor is displaced with filtrate direct to the accumulator 65, the filtrate being provided from tank 67. The chips are cold blown by compressed air, or by pumping, from the vessel 60 to the blow tank 68.

During the typical RDH™ process, white liquor is continuously preheated with liquor from the hot black liquor accumulator and then is stored in the hot white liquor accumulator 64. The black liquor passes to the warm weak black liquor accumulator 63, and the warm black liquor passes through a heat exchanger to make hot water and is stored in an atmospheric tank before being pumped to the evaporators.

With regard to FIG. 4, the only significant difference between the invention and the process described above is the heating of the black liquor, which may take place directly in accumulator 65, in such as way as to effect significant passivation of the DOM therein. For example this is accomplished by heating the black liquor to at least 20° C. above cooking temperature, e.g. under superatmospheric pressure to at least 170° C. for about 5–90 minutes, and preferably at or above 190° C. (e.g. 240° C.) for about 5–90 minutes. FIG. 4 schematically illustrates this additional heat being applied at 71; the heat may be from any desired source. During this pressure heating of the black liquor, off-gases rich in organic sulfur compounds are produced and withdrawn as indicated at 72. Typically, as known per se, the DMS (dimethyl sulfide) produced in the line 72 is converted to methane and hydrogen sulfide, and the methane can be used as a fuel supplement (for example to provide the heat in line 71) while the hydrogen sulfide can be used to pre-impregnate the chips at source 62 prior to pulping, can be converted to elementary sulfur and removed or used to form polysulfide, can be absorbed into white liquor to produce a high sulfidity liquor, etc. If the heat treatment in accumulator 65 is to about 20–40° C. above cooking temperature, black liquor can be utilized to facilitate impregnation during kraft cooking.

Alternatively, according to the invention, in the FIG. 4 embodiment, the valving mechanism 69 may be associated with a treatment stage, like stage 16 in FIG. 1, to remove DOM from cooking liquor being withdrawn from screen 61 and recirculated to the digester 60 during batch cooking.

Figure 5:
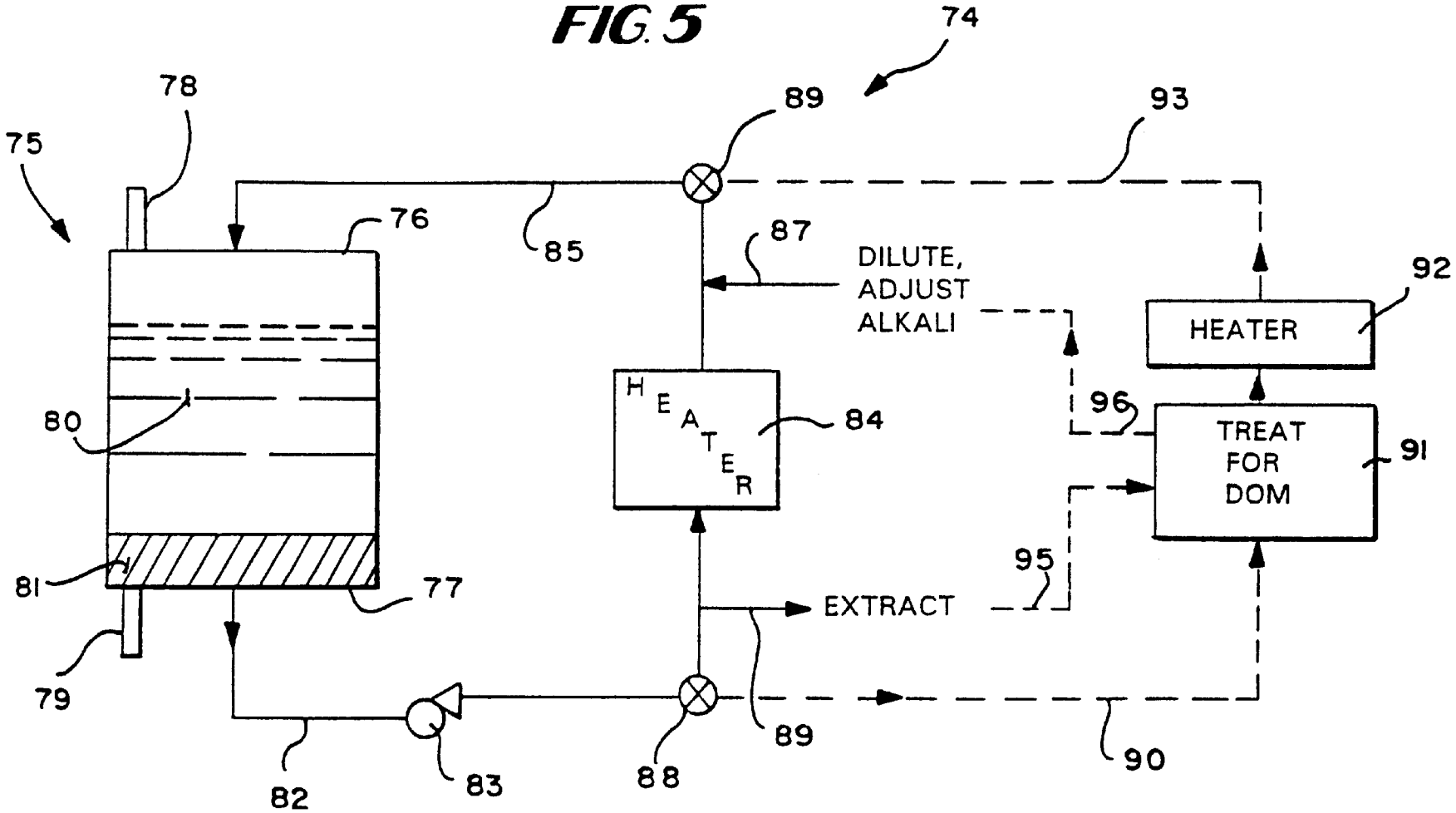
FIG. 5 is a schematic side view of another embodiment of exemplary batch digester according to the present invention.

FIG. 5 schematically illustrates an exemplary commercial (i.e. producing at least 8, e.g. 8–20, tons of pulp per day) batch digester system 74 according to the present invention. A laboratory size version of the solid line embodiment of system 74 as seen in FIG. 5 was used to obtain plot C from FIG. 2, and has ben in use for many years. The system 74 includes a batch digester 75 having a top 76 and bottom 77, with a chips inlet 78 at the top and outlet 79 at the bottom, with a chips column 80 established therein during cooking. A screen 81 is provided at one level therein (e.g. adjacent the bottom 77) connected to a withdrawal line 82 and pump 83, leading to a heater 84. From the heater 84 the heated liquid is recirculated through line 85 back to the digester 75, introduced at a level therein different than the level of screen 81 (e.g. near the top 76).

Prior to the heater 84, a significant portion (e.g. to provide about three turnovers of liquid per hour) of the withdrawn lignin in line 82 is extracted at line 86. This relatively high DOM concentration liquor is replaced by substantially DOM free (at least greatly reduced DOM concentration compared to that in line 86) liquor at 87. The substantially DOM-free liquor added at 87 may have an alkali concentration that is varied as desired to effect an appropriate kraft cook. A varying alkali concentration may be used to simulate a continuous kraft cook in the batch vessel 75. Valves 88, 89 may be provided to shut down or initiate liquor flows, and/or to substitute or supplement the desired treatment using the stem shown in dotted line in FIG. 5.

In accordance with the invention, instead of, or supplemental to, the extraction and dilution lines 86, 87, the desired level of DOM and its components (e.g. <50 g/l DOM, <25 g/l lignin, and <10 g/l hemi-cellulose) may be achieved by treating the extracted liquor for DOM, for example by passing the high DOM level liquor in line 90 to a treatment stage 91—like the stage 16 in FIG. 1—where DOM, or selected constituents thereof, are removed to greatly reduce their concentrations in the liquor. Makeup white liquor (not shown) can be added too, the liquor reheated in heater 92, and then returned via line 93 to the digester 75 instead of using line 90 and 93, lines 86 and 87 can be connected up to treatment unit 91, as schematically illustrated by dotted lines 95, 95 in FIG. 5.

Other laboratory test data showing advantageous results that can be achieved according to the present invention are illustrated in FIGS. 6 through 15. In this laboratory test data, procedures were utilized which simulate continuous digester operation b sequentially circulating heated pulping liquor through a vessel containing a stationary volume of wood chips. Different stages of a continuous digester were simulated by varying the time, temperature and chemical concentrations used in the circulations. The simulations used actual mill liquor when the corresponding stage of a continuous digester was reached in the lab cook.

Figure 6:
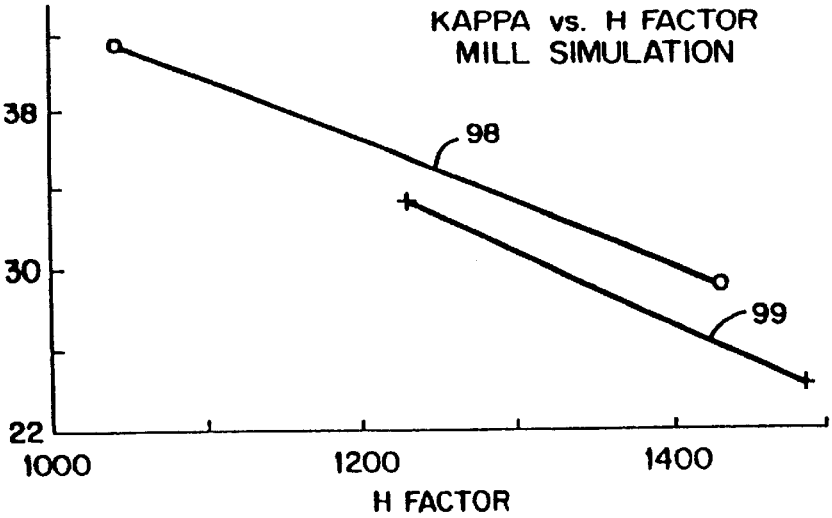
FIG. 6 is a graphical representation of the H factor for producing pulp according to the invention compared with kraft pulp produced under identical conditions not practicing the invention.

The effect of minimizing DOM in pulping liquors upon required pulping conditions (that, is, time and temperature) is illustrated in FIG. 6. FIG. 6 compares the relationship between Kappa number and H factor for laboratory cooks using mill black liquor and substantially DOM-free white liquor. The wood furnished for the cooks represented in FIG. 6 was a typical north-western United States soft wood composed of a mixture of cedar, spruce, pine and fir. The H factor is a standard parameter which characterizes the cooking time and temperature as a single variable and is described, for example, in Rydholm Pulping Processes, 1965, page 618.

Line 98 in FIG. 6 shows the relationship of Kappa number to H factor for a lab cook using mill liquor (collected at a mill and then used in a laboratory batch digester). A lower line, 99, indicates the relationship of Kappa number to H factor for a lab cook using substantially DOM-free white liquor manufactured in the lab. Lines 98, 99 indicate that for a given Kappa number, the H factor is substantially lower when the DOM is lower, for example, for Kappa number 30 in FIG. 6, there being approximately a 100 H factor units difference. This means that for the same furnish with the same chemical charge if lower DOM cooking liquor is utilized, a less severe cook (that is, less time and lower temperature) than for a conventional kraft cook is required. For example, by extracting liquor containing a level of DOM substantial enough to adversely affect the H factor, and replacing some or all of the extracted liquor with liquor containing a substantially lower effective DOM level than the extracted liquor so as to significantly reduce the H factor; preferably the steps are practiced to decrease the H factor at least about 5% to achieve a given Kappa number, and the steps are practiced to keep the effective DOM concentration at about 50 g/l or less during the majority of the kraft cook.

Figure 7:
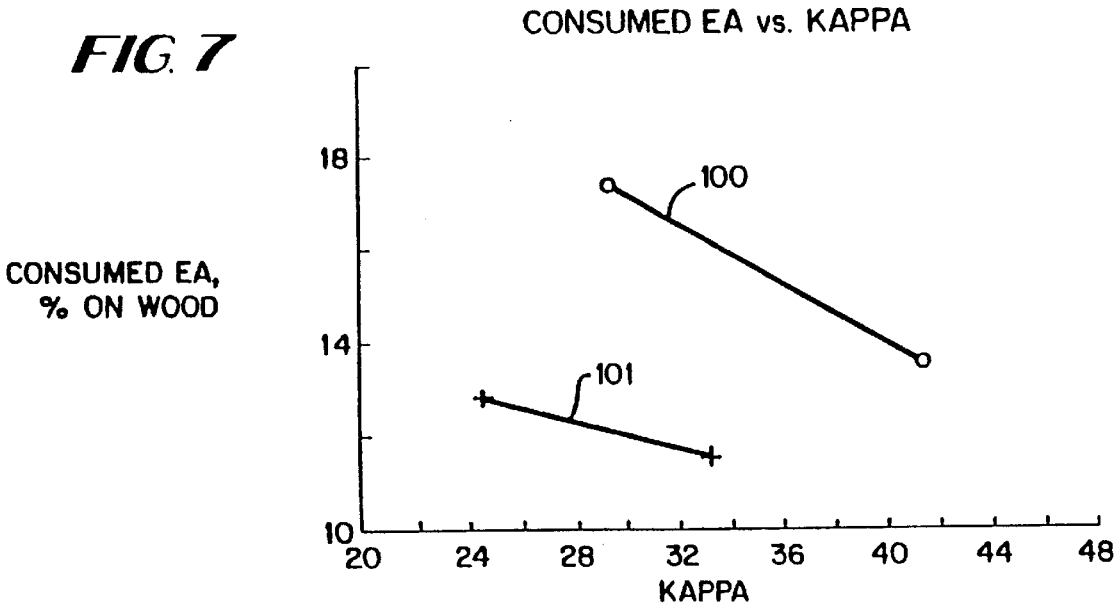
FIG. 7 us a graphical representation of the consumed effective alkali during the production of pulp according to the present invention compared with the production of pulp under identical conditions only not practicing the invention.

As illustrated in FIG. 7, when utilizing reduced DOM concentration according to the present invention, the effective alkali (EA) consumed is reduced EA is an indication of the amount of cooking chemicals, particularly NaOH and $Na_2S$ used in a cook. The results obtained in FIG. 7 were obtained utilizing the same furnish as in FIG. 6, and the two graph lines 100, 101 were obtained at the same conditions. Line 100 indicates the results when the cooking liquor was conventional mill liquor, while line 101 shows the results when the cooking liquor was substantially DOM-free white liquor. At a Kappa number of 30, the DOM-free cook consumed approximately 30% less alkali (i.e. 5% less EA on wood) than the conventional mill liquor cook. Thus, by extracting liquor containing a level of DOM substantial enough to adversely affect the amount of effective alkali consumed to reach a particular Kappa number, and replacing some or all of the extracted liquor with a liquor containing a substantially lower effective DOM level, the amount of effective alkali consumed to reach a particular Kappa number may be significantly reduced, e.g., the amount of alkali consumed may be decreased by at least about 0.5% on wood (e.g. about 4% on wood) to achieve a particular Kappa number.

Both the beneficial H factor and EA consumption results illustrated in FIGS. 6 and 7 may be achieved by replacing extracted relatively-high DOM liquor with water, substantially DOM-free white liquor, pressure heat-treated black liquor, filtrate, and combinations thereof.

Figure 8:
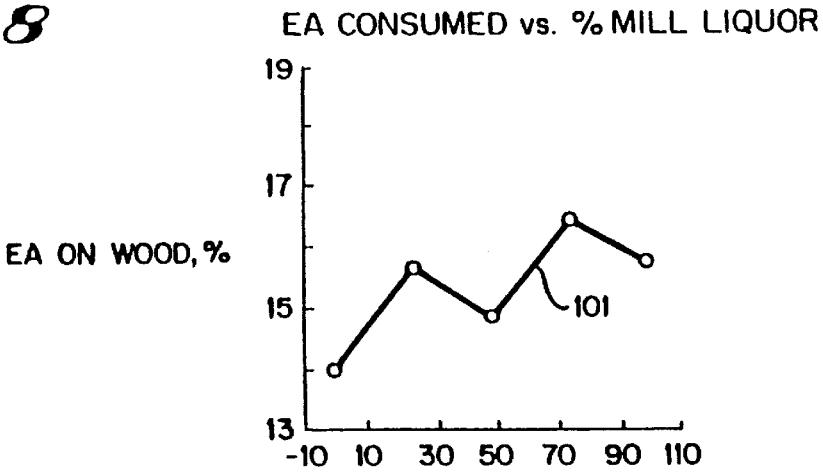
FIG. 8 is a graphical representation of the effective alkali consumed vs. a percentage of mill liquor compared to DOM-free liquor.

FIG. 8 provides a further graphical representation of effective alkali consumption compared to the percentage of mill liquor to substantially DOM-free white liquor. Plot 101 indicates that for the same relative Kappa number, the effective alkali consumed decreases with decreasing percent mill liquor (that is, increasing percent substantially DOM-free white liquor). Table 1 below shows the actual lab results which were used to make the plot 101 of FIG. 8.

TABLE 1

| | Effective Alkali Consumption | | | | |
|---|---|---|---|---|---|
| Cook Number Description | A3208 Mill Liq | A3219 75% mill | A3216 50% mill | A3239 25% mill | A3217 Lab Liq |
| Total EA consumed, % | 15.8 | 16.5 | 14.9 | 15.7 | 14.0 |

TABLE 1-continued

| | Effective Alkali Consumption | | | | |
|---|---|---|---|---|---|
| Cook Number Description | A3208 Mill Liq | A3219 75% mill | A3216 50% mill | A3239 25% mill | A3217 Lab Liq |
| Kappa, screened | 30.7 | 30.6 | 28.0 | 29.8 | 30.8 |

Reduction or elimination of DOM in pulping liquor also improves the ease with which the resulting pulp is bleached, that is, its bleachability.

Figure 9:
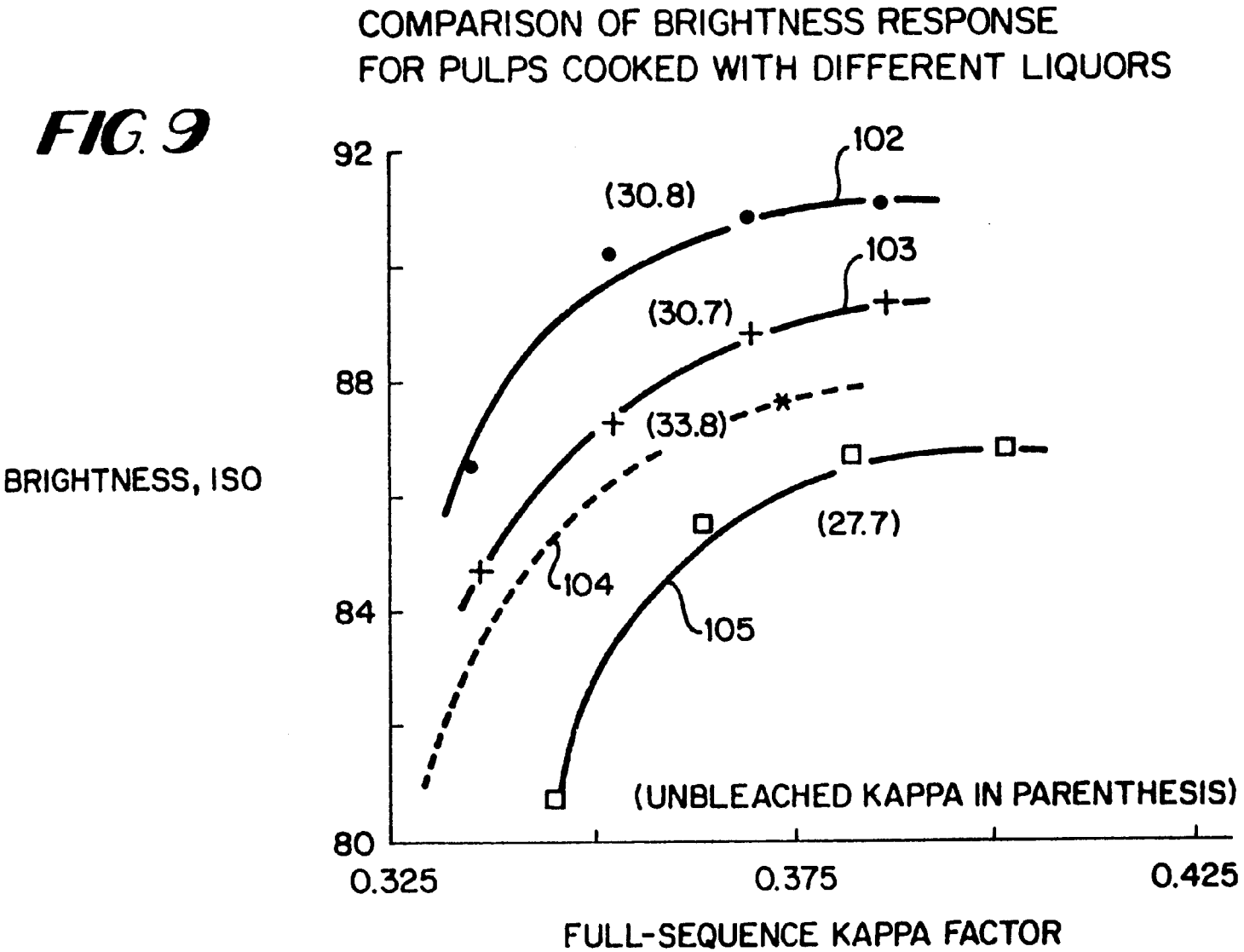
FIG. 9 is a graphical representation comparing brightness response for pulps produced according to the present invention compared with kraft pulp produced under identical conditions not practicing the invention.

FIG. 9 illustrates actual laboratory test results showing how the brightness of a bleached cedar-spruce-pine-fir pulp increases with the increase of bleaching chemical dosage. The parameter plotted on the X-axis of the graph of FIG. 9, the "full sequence Kappa factor", is a ratio of equivalent chlorine dosage to the incoming Kappa number of the pulp. That is, it is a somewhat normalized ratio of chlorine used to initial lignin content of the brownstock pulp. FIG. 9 thus shows how pulp brightness responds to the amount of bleaching chemical used.

The curves 102, 103, 104 and 105 of FIG. 9 are, respectively, substantially DOM-free white liquor (102), conventional mill liquor (103), a mill-cooked pulp (not a laboratory pulp using mill liquor) (104), and mill heat treated black liquor which was heat-treated (105). These graphical representations clearly indicate that the best bleachability is achieved when substantially DOM-free liquor is used for the cooking liquor. Thus, by extracting liquor containing a level of DOM substantial enough to adversely effect the bleachability of the pulp, and replacing some or all of the extracted liquor with liquor containing a substantially lower effective DOM, the bleachability of the pulp produced may be significantly increased, for example, at least one ISO brightness unit at a particular full sequence Kappa factor. Alternatively, this data indicates that a specific ISO brightness can be achieved while using a reduced bleaching chemical charge. However, graph line 105 indicates that while heat treated black liquor may improve delignification (see FIG. 2), the residual lignin may not be as easily removed. Thus, the treated black liquor may not be desirable for use as a dilution liquor where increased bleachability is desired, but rather water, substantially DOM-free white liquor, and filtrate (as well as combinations thereof) would be more suitable as dilution liquors. However, the heat-treated liquor may be used for pulp that is not bleached, i.e., unbleached grades.

Figure 11:
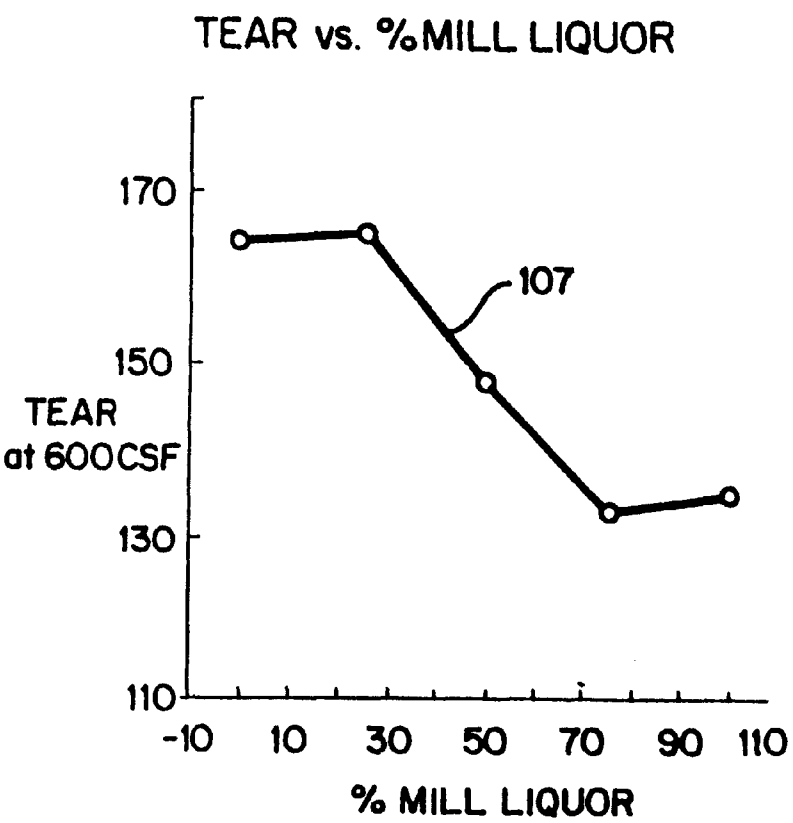
Figure 10:
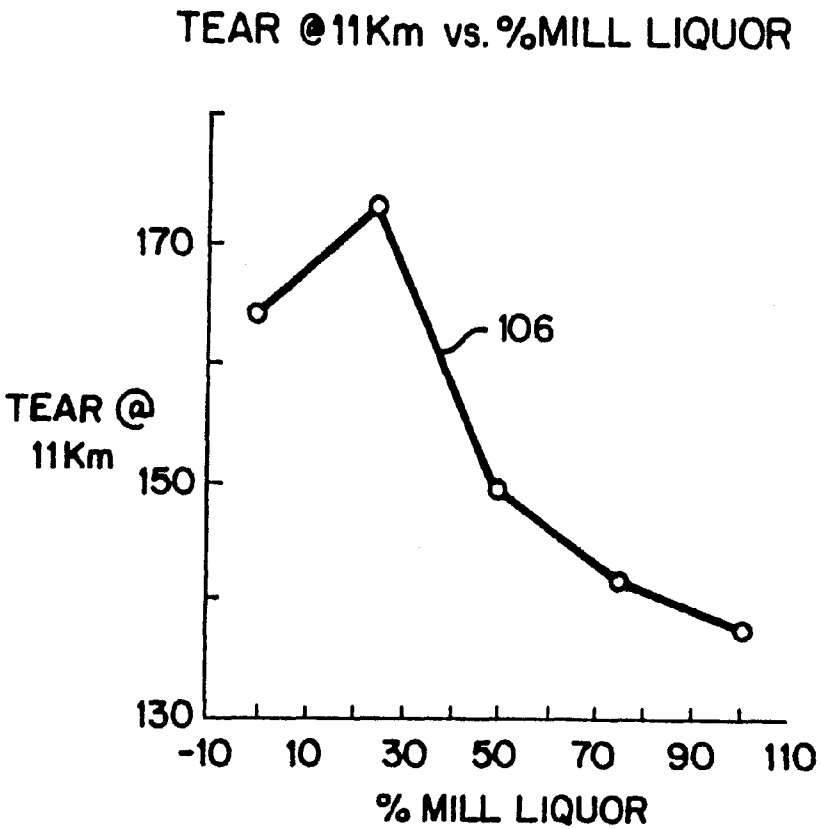

As earlier discussed, reducing the DOM concentration of pulping liquors appears to have the most dramatic effect upon pulp strength. This is further supported by data graphically illustrated in FIGS. 10 through 14B. All of this data is for the same cedar-spruce-pine-fir furnish as discussed above with respect o FIGS. 6 through 9, and this data indicates that under the same cooking conditions the tear strength significantly increases as the amount of DOM increases. For example, FIG. 10 indicates that the tear strength at 11 km increases (see line 106) as the amount of mill liquor decreases (and thus the amount of substantially DOM-free white liquor increases) for the laboratory cooks illustrated there. FIG. 11 indicates the same basic relationship by graph line 107, which plots percentage mill liquor versus tear at 600 CSF.

Table 2 below shows the tear strength at two tensile strengths for lab cooks performed with various liquors, with a tear for a mill-produced pulp shown for comparison. The data from cooks 2 and 3 in Table 2 indicate a twenty percent (20%) increase for tear at 10 km tensile for the lab cook with substantially DOM-free white liquor compared with a lab cook using mill liquor, and a twelve percent (12%) increase is indicated for tear at 11 km tensile. Lab cooks. 4, 5 and 6 in Table 2 show the result of replacing DOM-free liquor in specific parts of the cook with corresponding mill liquor. For example, in cook 4 the liquor from the bottom circulation, BC, line replaced the lab-made liquor in the BC stage of the lab cook. Similarly, in cook 5 BC and modified cook, MC, mill liquor was used in the lab cook in the BC and MC stages, while substantially DOM-free liquor was used in the other stages. The data in Table 2 indicate that minimization of DOM is critical throughout the cook, not simply in later stages, and fully supports the analysis provided above with respect of FIGS. 2 and 3.

TABLE 2

Effect of Dissolved Organics on Pulp Tear Strength for Hemlock Furnish

| Cooking Conditions | | Tear @ 10 km | Tear @ 11 km |
|---|---|---|---|
| 1) Mill Cook | | 123 | N/A |
| 2) Lab Cook w/Mill Liquor | (A) | 174 | 156 |
| | (B) | 173 | 150 |
| Average | | 173.5 | 153 |
| 3) Lab Cook w/Lab Liquor | (A) | 207 | 174 |
| | (B) | 206 | 170 |
| Average | | 206.5 | 172 |
| 4) Lab Cook w/Mill BC Liquor | | 183 | 159 |
| 5) Lab Cook w/Mill BC and MC Liquor | | 181 | 157 |
| 6) Lab Cook w/Mill Wash Circulation Liquor | | 187 | N/A |

FIGS. 12A–14B illustrate the effect of DOM upon bleached pulp strength. FIG. 12A shows the tear and tensile strength for unbleached pulp, line 108 showing pulp produced substantially DOM-free lab liquor, line 109 from pressure-heat treated black liquor, and line 110 from conventional mill liquor. FIG. 12B shows the tear versus tensile relationship after the pulps graphically illustrated in FIG. 12A were bleached utilizing the laboratory bleach sequence of $DE_0D(nD)$. Line 111 shows the substantially DOM-free-white-liquor-produced, bleach pulp; and line 113, 1 conventional mill-liquor-produced, bleached pulp, while, for comparison, line 114 shows the strength of the mill pulp taken from the decker, after bleaching. FIG. 12B shows that not only is the substantially DOM-free cooked pulp stronger than the mill liquor pulp, but this relative strength is maintained after bleaching. The heat treated liquor cooked pulp also maintains higher strength than the mill liquor cooked pulp after bleaching, but the difference in strength after bleaching is minimal.

FIGS. 13A and 13B plot the results of testing of the same cooks/bleaches as FIGS. 12A and 12B only tear factor is plotted against Canadian standard freeness (CSF). Line 115 is substantially DOM-free pulp; line 116, pressure-heat-treated-mill-liquor-produced pulp; line 117, mill-liquor-produced pulp; line 118, bleached substantially DOM-free-produced pulp; line 119, pressure-heat-treated-liquor-produced, bleached pulp; line 120, bleached mill-liquor-produced pulp; and line 121, taken at the mill decker.

FIGS. 14A and 14B are plots of same cooks/bleaches as in FIGS. 12A and 12B only plotting tensile vs. freeness. Line 122 is for mill-liquor-produced pulp; line 123, for pressure-heat-treated-mill-liquor-produced pulp; line 124, for substantially DOM-free produced pulp; line 125, for mill-liquor-produced, bleached pulp; line 126, for substantially DOM-free-liquor-cooked, bleached pulp; line 127, at the decker; and line 128, for pressure-heat-treated-mill-liquor-cooked bleached pulp. FIGS. 14A and 14B show that tensile declines for both heat-treated-liquor-cooked pulp and substantially DOM-free-liquor-cooked pulp, however FIG. 14B shows that the bleaching reduces the relative tensile strength of the heat-treated liquor pulp below that of the DOM-free liquor cooked pulp. Again, as noted above, the heat-treated-liquor process may be suitable for unbleached pulps.

Figure 15:
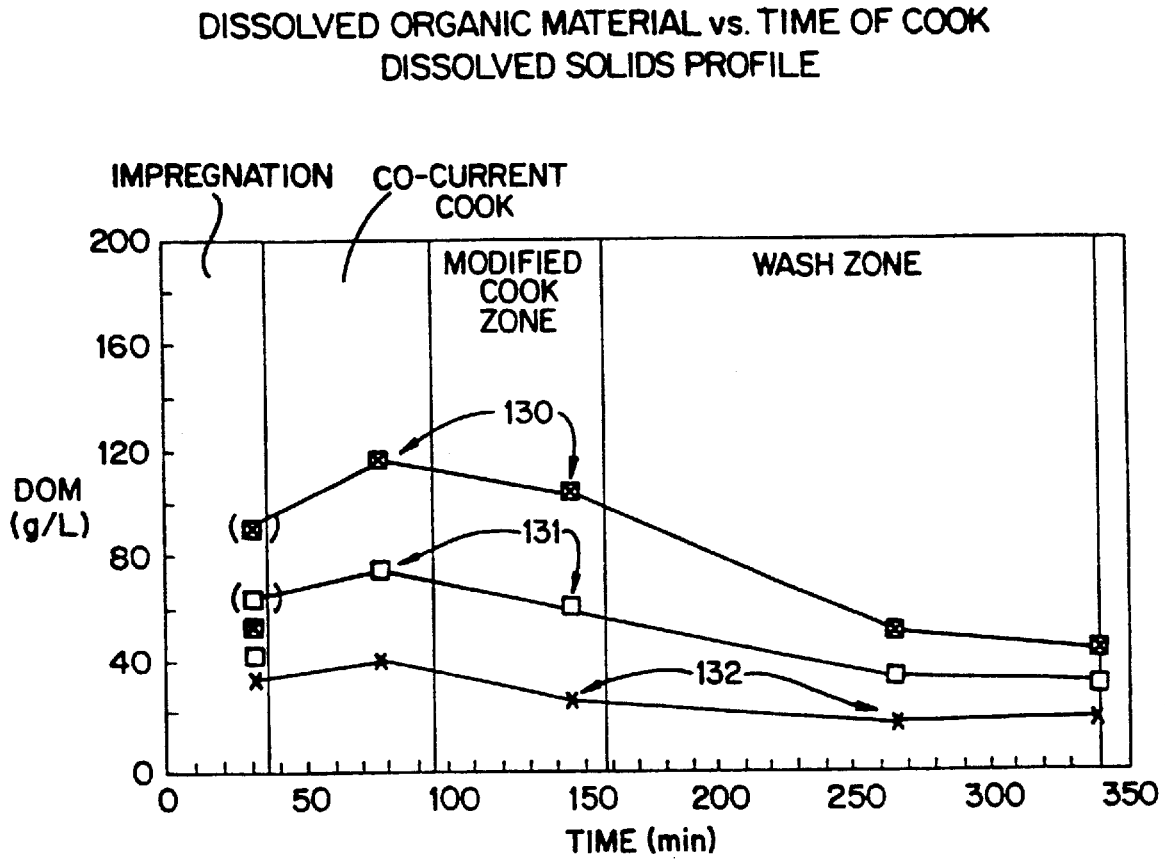
FIG. 15 is a graphical representation of DOM concentrations based upon actual liquor analysis for lab cooks with three different sources of liquor at various stages during cooking.

The laboratory cooks discussed above all simulated the pulping sequence of a Kamyr, Inc. MCC® continuous digester. Each lab cook has a corresponding impregnation stage, co-current cooking stage, counter-current MCC® cooking stage, and a counter-current wash stage. Typical DOM concentrations based upon actual liquor analysis are shown in FIG. 15 for lab cooks with three sources of liquor. The line 130 is for mill liquor, line 131, for 50% mill liquor and 50% substantially DOM-free lab white liquor; and the X's 132, for 100% substantially DOM-free lab white liquor. In FIG. 15, note that at time=0, the beginning of impregnation, all lab liquors used were DOM-free. This was done because there was no reliable method of sampling the liquor at this stage of the cook in the mill. Thus, the DOM concentrations of the mill and 50/50 liquor cooks at the end of impregnation are lower than expected for this set of data, and more representative concentrations are extrapolated and shown in parenthesis in FIG. 15. FIG. 15 does show how each of the concentrations follow a consistent trend throughout the cook, the concentrations gradually increasing until the extraction stage and then gradually decreasing during the counter-current MCC® and wash stages. Even with a substantially DOM-free source of liquor, of course, DOM is released into the liquor as cooking proceeds.

Figure 16:
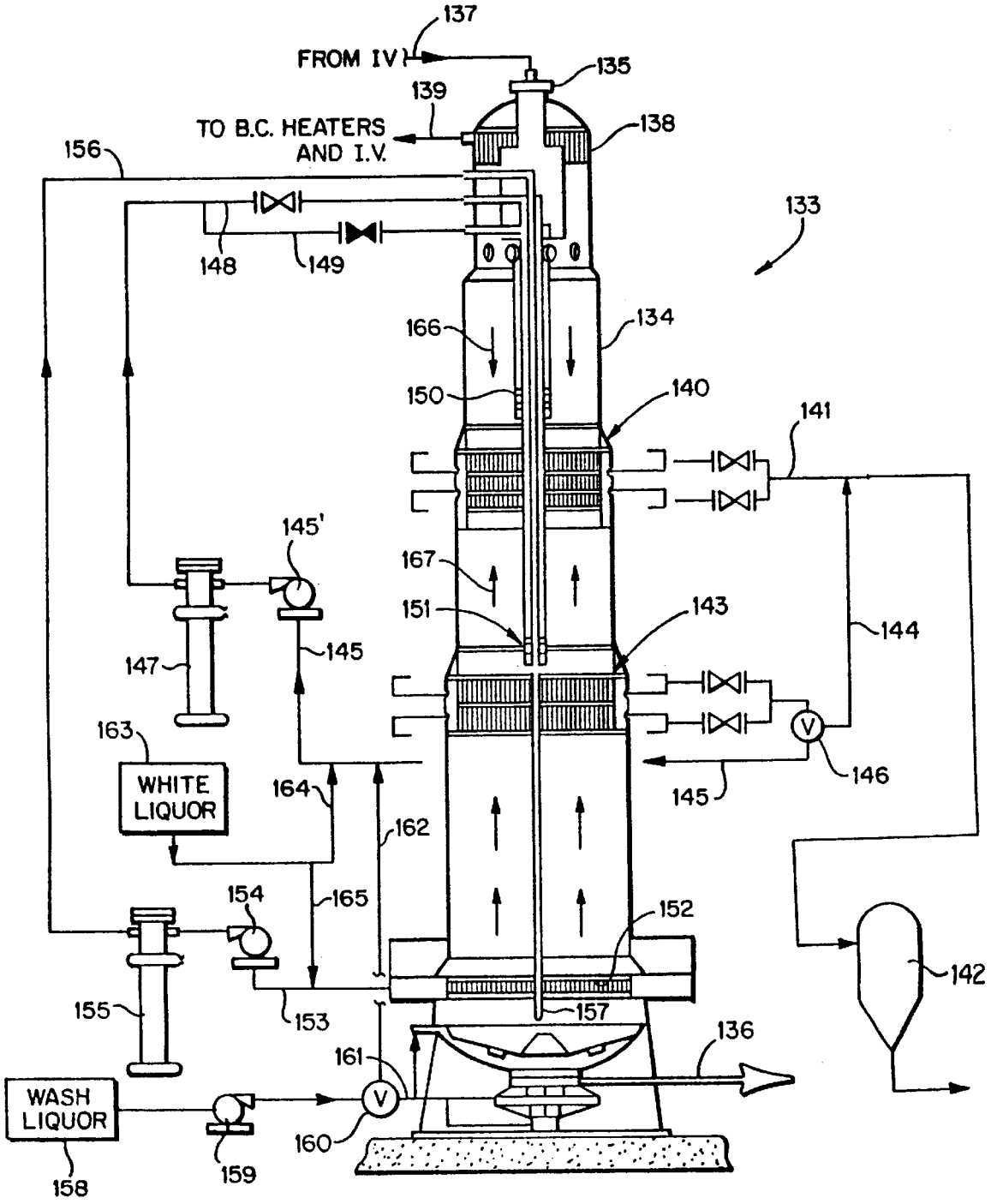
FIG. 16 is a schematic illustration of an exemplary digester of a two vessel hydraulic cooking system which practices the present invention.

FIG. 16 illustrates an exemplary continuous digester system 133 that utilizes the teachings of the present invention to produce pulp of increased strength. System 133 comprises a conventional two-vessel Kamyr, Inc. continuous hydraulic digester with MCC® cooking, the impregnation vessel not being shown in FIG. 16, but the continuous digester 134 being illustrated. FIG. 16 illustrates a retrofit of the conventional MCC® digester 134 in order to practice the lower DOM cooking techniques according to the present invention.

The digester 134 includes an inlet 137 at the top thereof and an outlet 136 at the bottom thereof for produced pulp. A slurry of comminuted cellulose fibrous material (wood chips) is supplied from the impregnation vessel in line 137 to the inlet 138. A top screen assembly 138 withdraws some liquor from the introduced slurry in line 139 which is fed back to the BC heaters and the impregnation vessel. Below the top screen assembly 138 is an extraction screen assembly 140 including a line 141 therefrom leading to a first flash tank 142, typically of a series of flash tanks. Below the extraction screen assembly 140 is a cooking screen assembly 143 which has two lines extending therefrom, one line 144 providing extraction (merging with the line 141), and the other line 145 leading to a pump 145'. A valve 146 may be provided at the junction between the lines 144, 145 to vary the amount of liquor passing in each line. The liquor in line 145 passes through a heater 147 and a line 148 to return to the interior of the digester 134 via pipe 151 opening up at about the level of the cooking screen assembly 143. A branch line 149 also may introduce recirculated liquid in pipe 150 at about the level of the extraction screens 140. Below the cooking screen assembly 143 is the wash screen asembly 152, with a withdrawal line 153 leading to the pump 154, passing liquor through heater 155 to line 156 to be returned to the interior of the digester 134 via pipe 157 at about the level of the screen 152.

For the system 133, the mill has presently increased the digester's production rate beyond the production rate it was designed for, and production is presently limited by the volume of liquor that can be extracted. This limitation can be circumvented by utilizing the techniques according to the invention, as specifically illustrated in FIG. 16. Since, the amount of extraction in line 141 is limited, this will be augmented according to the present invention by supplying extraction also from line 144. For example, the rate of extraction will be, utilizing the invention, typically about 2 tons of liquor per ton of pulp. In effect, 1 ton of liquor per ton of pulp extracted at line 144 is replaced with dilution liquor (wash liquor) from the source 158. This is accomplished in FIG. 16 by passing the wash liquor from source 158 (e.g. filtrate water) through a pump 159, and valve 160, the majority of the wash liquor (e.g. 1.5 tons liquor per ton of pulp) being introduced in line 161 to the bottom of the digester, while the rest (e.g. 1 ton of liquor per ton of pulp) passing in line 162 into the line 145 to provide the dilution liquor. Also, substantially DOM-free white liquor from source 163 may be added in line 164 to the line 145 prior to heater 147, and recirculation back to the digester through pipes 150 and/or 151. Of course, white liquor may also be added to the wash circulation in line 153 (see line 165) to effect EMCC® cooking. The flow arrows 166 illustrate the co-current zone in digester 134. As a result of the modifications illustrated in FIG. 16, the counter-current flow in the MCC® cooking zone 167 will contain cleaner, DOM-reduced, liquor with improved results in pulp strength, and in this case also an increase in the digester 134 production rate.

Figure 17:
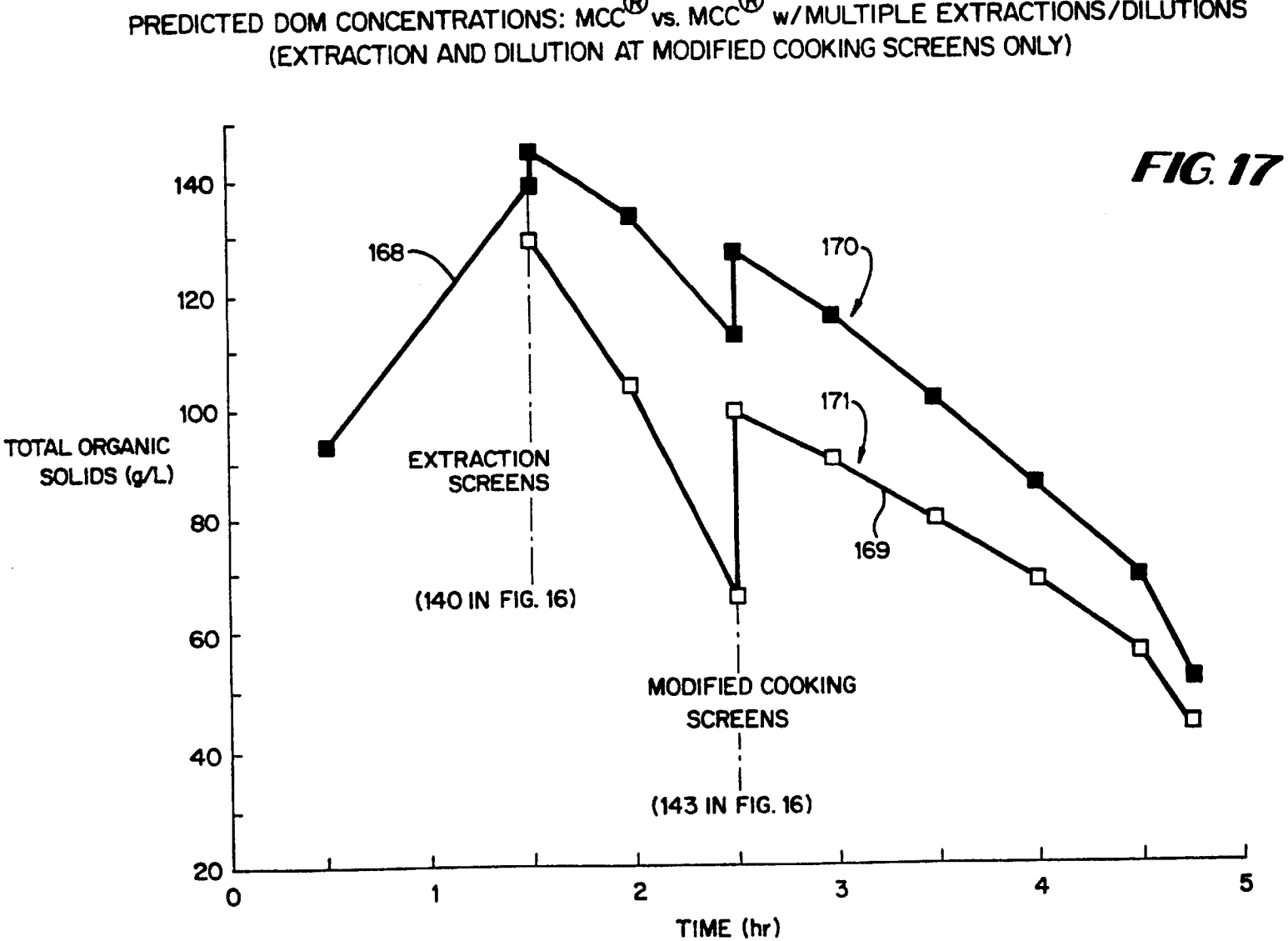
FIG. 17 is a graphical representation of a theoretical investigation comparing DOM concentration in a conventional MCC® digester compared with the digester of FIG. 16.

The effect of the modifications illustrated in FIG. 16 upon DOM concentration has been investigated using a dynamic computer model of a Kamyr, Inc. continuous digester. Preliminary results of this theoretical investigation are illustrated schematically in FIG. 17. FIG. 17 compares variation in DOM concentration in a conventional MCC® digester with the digester illustrated in FIG. 16, the conventional MCC® digester results being illustrated by line 168, and the digester of FIG. 16 results by line 169. As can be seen in FIG. 17, the DOM concentration at the screen assembly 143 drops dramatically with the addition of DOM-reduced dilution, also reducing the DOM in the counter-current flow back up to the extraction screen assembly 140. Furthermore, the downstream, counter-current wash liquor contains less DOM since less DOM is being carried forward with the pulp. Graph lines 170, 171, part of the lines 168, 169, indicate that in the counter-current cooking zone the DOM always increases in the direction of liquor flow. That is, the counter-current flow is cooking and accumulating DOM as it passes through the down-flowing chip mass.

FIGS. 16 and 17 thus illustrate the dramatic impact of only a single extraction-dilution upon the DOM profile in a continuous digester, which DOM reduction may have a corresponding dramatic effect upon resulting pulp strength.

Figure 18:
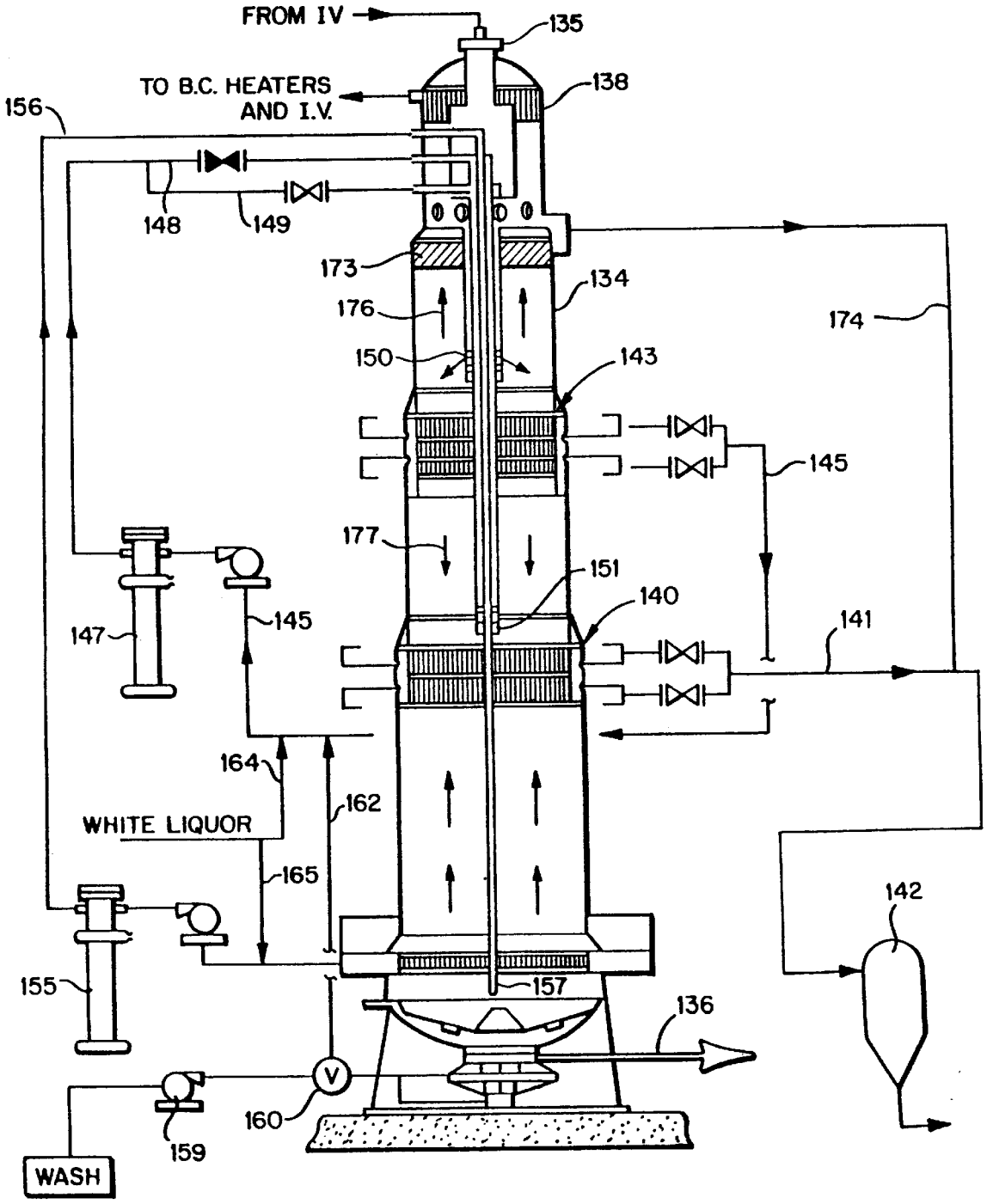
FIGS. 18 through 20 are schematic illustrations of other exemplary digesters according to the present invention.

FIG. 18 illustrates another mill variation implementing techniques according to the invention. This also indicates a digester 134 that is part of a two-vessel hydraulic digester. Since many of the components illustrated in FIGS. 16 and 18 are the same, they are indicated by the same reference numerals. Only the modifications from one to the other will be described in detail.

In the FIG. 18 embodiment, an even more dramatic DOM reduction will occur. In this embodiment, the screens 140, 143 are reversed compared to the FIG. 16 embodiment, and also another screen assembly 173 is provided between the screen assemblies 138, 143. The screen assembly 173 is a trim screen assembly; according to the invention the withdrawal conduit 174 therefrom provides extraction to the flash tank 142.

In the embodiment of FIG. 18, as one particular operational example, two tons of liquor per ton of pulp will be extracted in line 174, and four tons of liquor per ton of pulp in line 141. Dilution liquor will be added in line 162 and substantially DOM-free white liquor in line 164. This will result in the flows 176, 177 illustrated in FIG. 18, the digester 134 thus being characterized as co-current, counter-current, co-current, counter-current flow (which may be called alternate-flow continuous cooking).

Figure 19:
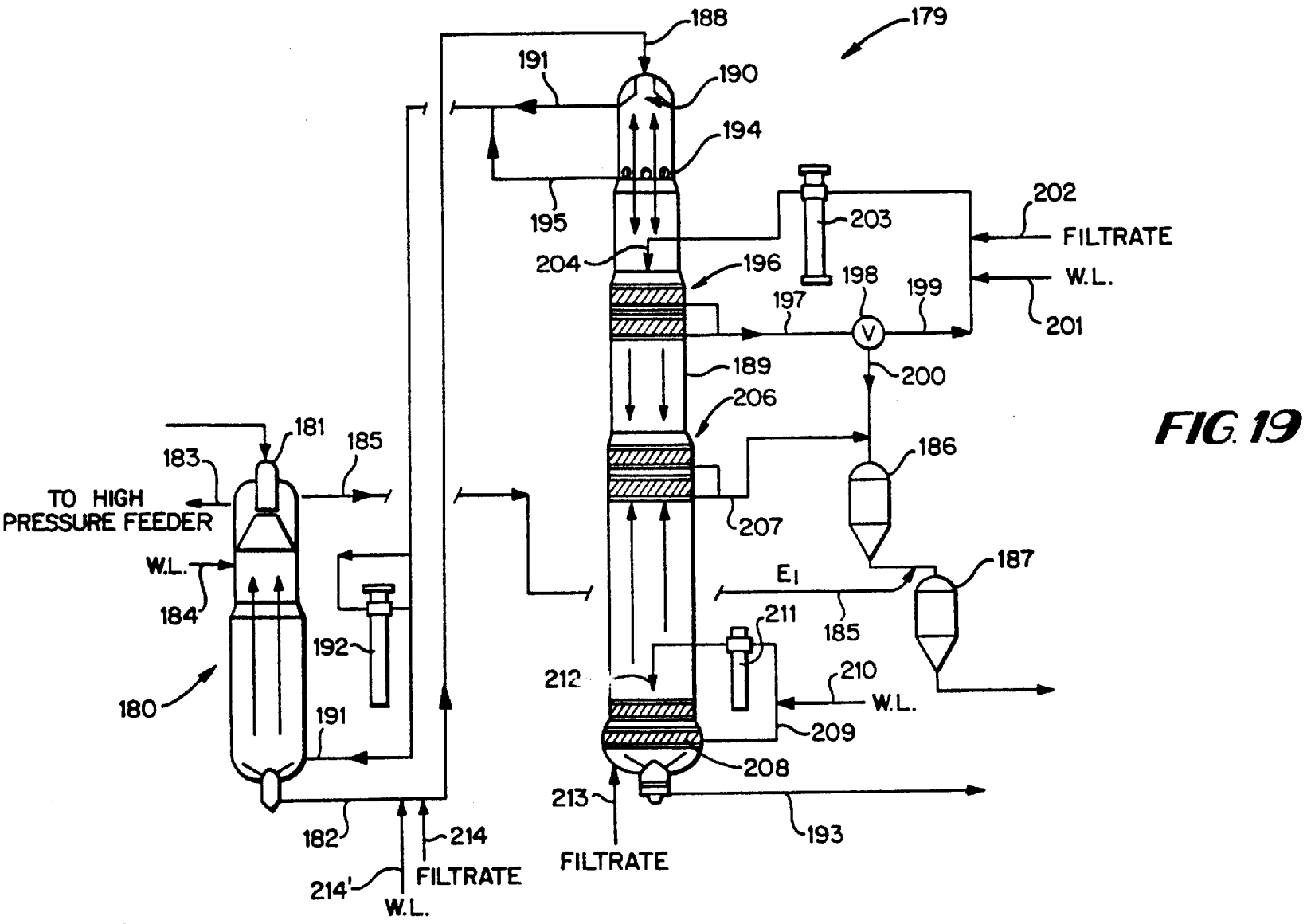

FIG. 19 illustrates another digester system 179 according to the present invention. In this two-vessel system, the impregnation vessel 180 is illustrated, having an inlet 181 at the top thereof and an outlet 182 at the bottom. Liquid withdrawn at 183 is recirculated to the conventional high pressure feeder, while white liquor is added at 184. Liquor withdrawn at 185 may be passed to an introduction point between the first flash tank 186 and second flash tank 187. The slurry from the line 182 is introduced at 188 into the top of the digester 189, having a "still well" arrangement 190, from which liquor is withdrawn at 191 and recirculated to the bottom of the impregnation vessel 180. The liquor is heated in heater 192 when recirculated.

Digester 189 also has a trim screen assembly 194 with the withdrawal 195 therefrom in this case merging with the recirculating liquid in line 191. Cooking screen assembly 196 is provided below the trim screen assembly 184, with liquid withdrawn in line 197 passing through valve 198 into a line 199, and optionally some of the liquid passing from valve 198 being directed in line 200 to the flash tank 186. The liquid in line 199 is diluted with lower DOM liquor, such as the substantially DOM-free white liquor 201 and the filtrate 202, before passing through heater 203 and being reintroduced into the digester 189 by the conduit 204 at about the level of the screen assembly 196. The extraction screen assembly 206 has a withdrawal line 207 therefrom which leads to the flash tank 186. The wash screen assembly 208 includes recirculation line 209 to which white liquor at 210 may be added before the liquor passes through heater 211, and then is reintroduced by a conduit 212 at about the level of the wash screen assembly 208. Filtrate providing wash liquor is added at 213, while the produced pulp is withdrawn in line 193.

Note that the system 179 has the potential to extract from line 197, through valve 198 into conduit 200. The dilution liquid in the form of filtrate also is preferably added at 214 to the line 182, while substantially DOM-free white liquor is added at 214'.

Figure 20:
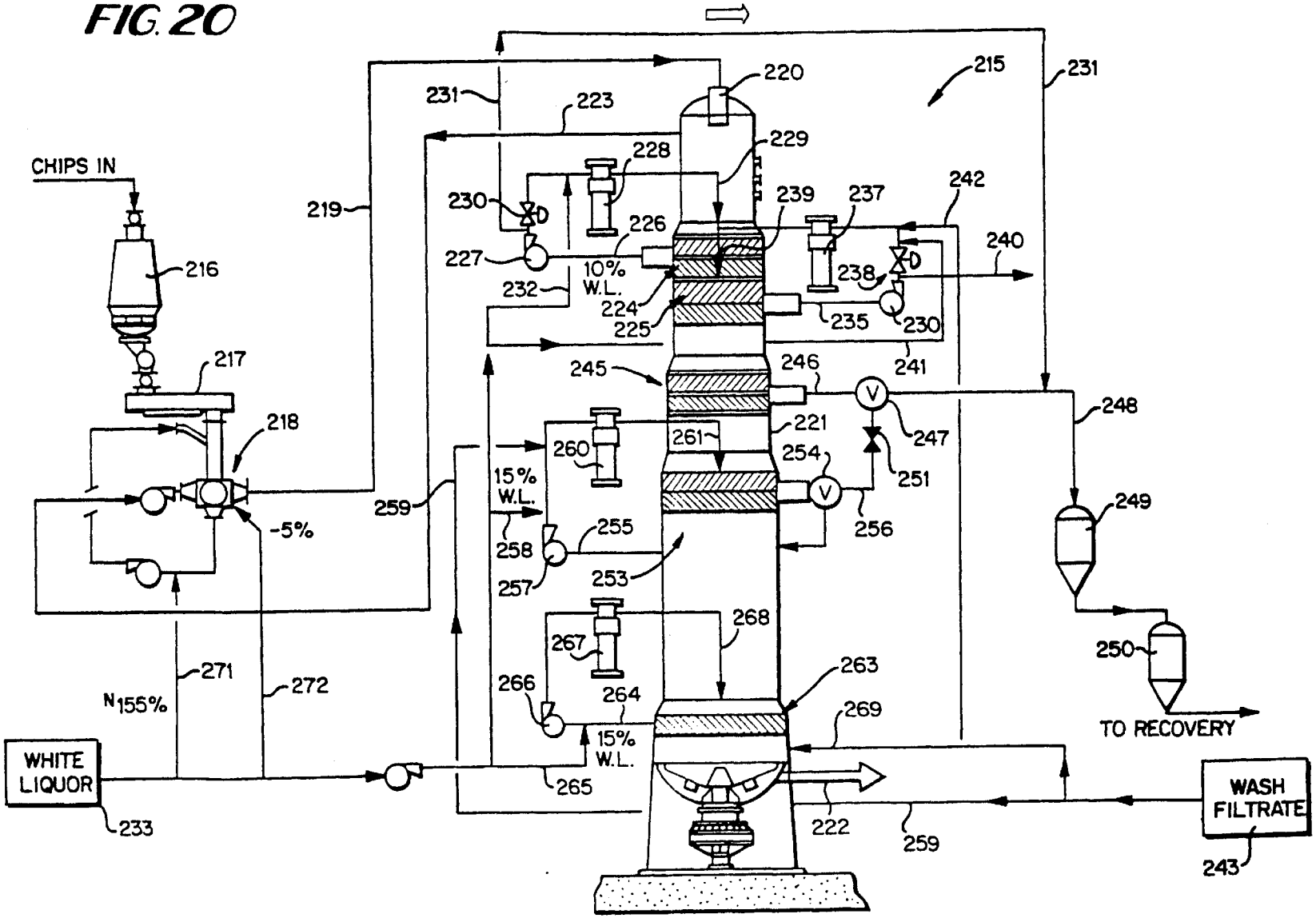

FIG. 20 illustrates a one vessel hydraulic digester that is modified according to the teachings of the present invention, this modification also including two sets of cooking screens, as is conventional. This increases the potential for the introduction of extraction/dilution at two more locations.

The single vessel hydraulic digester system 215 includes the conventional components of chips bin 216, steaming vessel 217, high pressure transfer device (feeder) 218, line 219 for adding cellulose fibrous material slurry to the top 220 of the continuous digester 221, and a withdrawal 222 for produced pulp at the bottom of the digester 221. Some of the liquid has been withdrawn in line 223 and recirculated back to the high-pressure feeder 218. The cooking screens are below the line 223, e.g. the first cooking screen assembly 224 and the second cooking screen assembly 225.

Associated with the first cooking screen assembly 224 is a first means for recirculating the first portion of liquid withdrawn from the cooking screen assembly 224 into the interior of the digester 221, including line 226, pump 227, and heater 228, with reintroduction conduit 229 at about the level of the screen assembly 224. A valve 230 may be provided for extraction prior to the heater 228, into line 231, while dilution liquid, such as white liquor (e.g. 10% of the total white liquor utilized) is added by a conduit 232 just prior to the heater 228.

Second means for recirculating some withdrawn liquor, and extracting other withdrawn liquor, is provided for the second cooking screen assembly 225. This second system comprises the conduit 235, pump 236, heater 237, valve 238, and reintroduction conduit 239. One portion of the liquid is augmented with dilution liquid in conduit 242 while dilution liquid in the form of white liquor is added in line 241, and while some liquor is extracted in line 240. In this way, the DOM concentration is greatly reduced in the cooking zone adjacent the screen assemblies 224, 225.

Located below the second cooking screen assembly 225 is extraction screen assembly 245 having a conduit 246 extending therefrom to a valve 247. From the valve 247 one branch 248 goes to the first flash tank 249 of a recovery system which typically includes a second flash tank 250. Some of the liquor in line 246 may be recirculated by directing valve 247 into line 251.

The digester 221 further comprises a third screen assembly 253 located below the extraction screen assembly 245, and including a valve 254 branching out into a withdrawal conduit 255 and an extraction conduit 256. That is, depending upon the positions of the valves 247, 254, liquid may flow from line 246 to line 255, or from line 256 to line 248.

The line 255 is connected by pump 257 to heater 260 and return conduit 261 at about the level of the third screen assembly 253. Dilution liquor is added to the line 255 before the heater 260, white liquor (e.g. about 15% of the white liquor used for cooking) being added via line 258, and dilution liquid, such as wash filtrate, from source 243 being added via line 259.

The digester 221 also includes a wash screen assembly 263 including a withdrawal conduit 264 to which white liquor from source 233 may be added (e.g. 15% of the total white liquor for the process) via line 265. A pump 266, heater 267, and return conduit 268 for re-introducing withdrawn liquid at about the level of the screen assembly 263, are also provided. Wash filtrate is also added below the screen assembly 263 by conduit 269 connected to wash filtrate source 243.

In one exemplary operation according to the invention, 55% of the white liquor used for treatment of the pulp is added in line 271 to impregnate the chips as they are handled by the high pressure transfer device 218 and sluiced into the line 219, 5% is added to the high pressure feeder 218 via line 272, 10% is added, collectively, in lines 232, 241 (e.g. 5% each), and 15% is added in each of the lines 258, 265.

Utilizing the single vessel hydraulic continuous digester assembly 215 of FIG. 20, a low level of DOM will be maintained, and additionally, there are numerous modes of operation. For example, at least each of the following three modes of operation may be provided.

(A) Extended modified continuous cooking with extraction/dilution at the lower cooking screens: In this mode, the digester 221 operates with conventional extraction in line 246, and with extended modified continuous cooking, white liquor being added in 232, 258, 265. Extraction also occurs in line 240 with a corresponding dilution liquor added at 242 from the wash filtrate 243, resulting in a DOM-reduced liquor flow either counter-current or co-current between the extraction screen assembly 245 and the low cooking screen assembly 225. Whether the flow is counter-current or co-current depends upon the values of the extractions at 240, 246.

(B) Extended modified continuous cooking with extraction/dilution at modified continuous cooking circulation: In this mode, all of the flows just described with respect to (A) are utiliaed and in addition an extraction occurs in line 256, valves 247, 254 being controlled to allow a portion of the liquid from the third screen assembly 253 (the modified continuous cooking screen assembly) to pass to line 248. Dilution liquid to make up for this extraction is added at 259, resulting in yet another reduced DOM, counter-current liquid flow between the screen assemblies 245, 253.

(C) Displacement impregnation and extraction dilution in upper cooking screens: This mode may be used alone or with a conventional modified continuous cooking process, or in addition to the modes (A) and (B) above. This mode includes extraction at the upper screen assembly 224, as indicated by a line 231, under the control valve 230, and dilution with white liquor in line 232. Additional dilution can be provided from line 259 (not shown in FIG. 20). This results in displacement impregnation, which occurs when a counter-current flow at the inlet to the digester is induced not by an extraction, but by the liquor content of the incoming chips. Low liquor content of the chips will cause the hydraulically-filled digester 221 to force dilution flow back up into the inlet 220 which results in a counter-current flow of reduced DOM liquor.

The system 215 illustrated in FIG. 20 is not limited to the modes A–C described above, but those modes are only exemplary of the numerous modified forms the flow can take to utilize the low DOM principles according to the present invention to produce a pulp of increased strength.

Note that all of the embodiments of FIGS. 16 and 18 through 20 may be retrofit to existing mills, and exact details of how the various equipment is utilized will depend upon the particular mill in which the technology is employed. All will result in the benefits of reduced DOM described above, e.g. enhanced strength, enhanced bleachability, reduced effective alkali consumption, and/or lower H factor. This is best demonstrated for the configuration of FIG. 19 with respect to FIGS. 21–25.

In FIG. 19, 185 is considered the first extraction, 200 the second extraction, 207 the third extraction, 214 the first dilution, 202 the second dilution, and 213 the third dilution.

Figure 21:
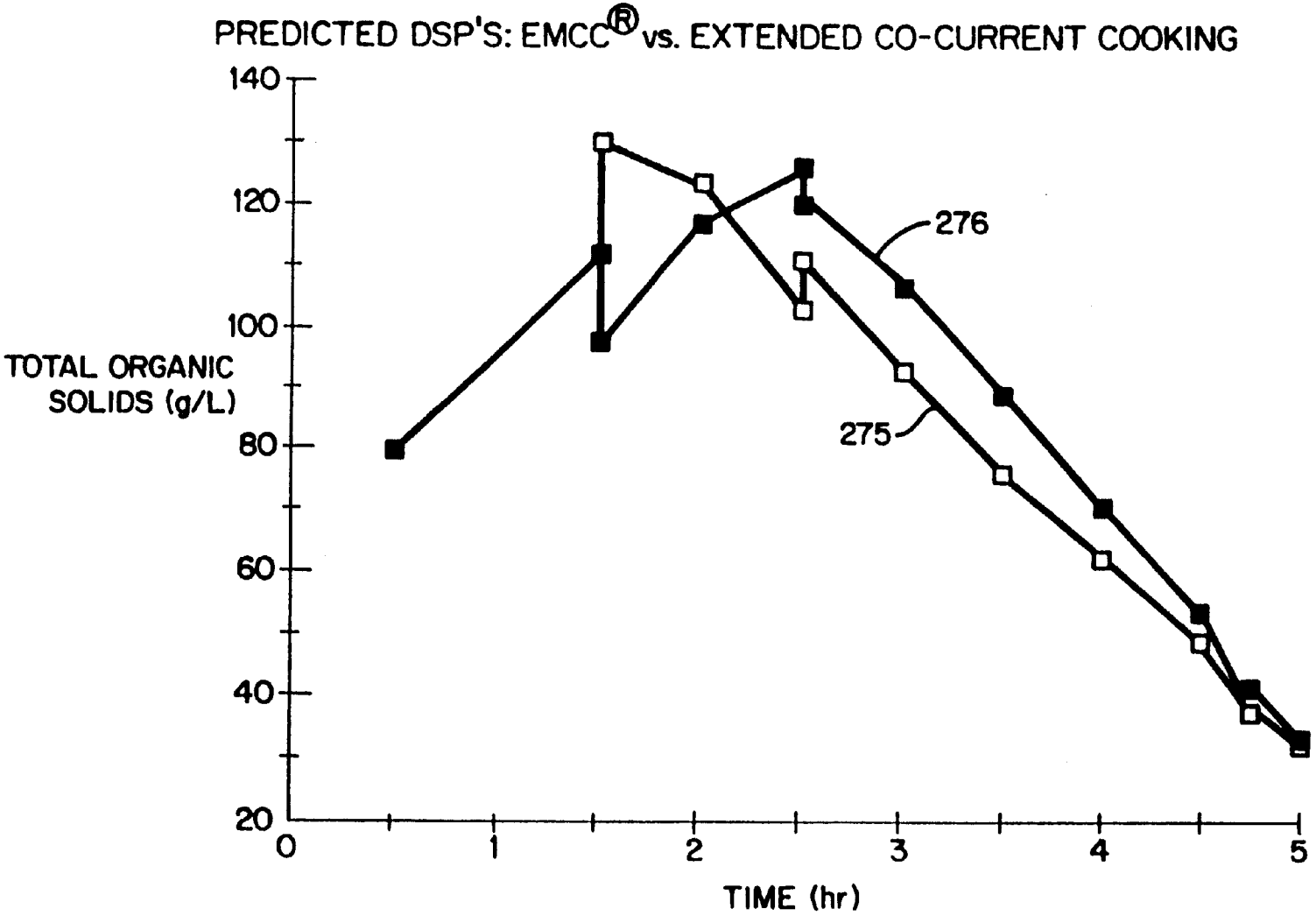
FIGS. 21 through 25 are graphical representations of theoretical investigations of varying dilution and extraction parameters using the digester of FIG. 19.

FIG. 21 shows a computer simulation comparison of the DOM profiles for a standard EMCC® cook and a similar cook according to the invention using the system of FIG. 19 with extended co-current cooking. In a standard EMCC® cook, extraction is from conventional extraction screens and white liquor is added to the conventional cooking circulation and wash circulation, with the liquor flow from the top of the digester to the conventional extraction screens being co-current, while the flow for the remainder of the digester is counter-current. According to the extended co-current mode of FIG. 21, the third extraction 207 is the primary extraction so that co-current cooking takes place all the way to screen assembly 206. FIG. 21 shows the conventional EMCC® cook by graph line 275, and the cook according to the extended co-current cooking mode by graph line 276. In the computer model generating FIG. 21, the tonnage rate was 1200 ADMT/D and the distribution of white liquor was 60% in the impregnation 184, 5% in the BC line 214', 15% in the MCC® circulation 201, and 20% in the wash circulation 210. At 213 1.5 tons of liquor per ton of pulp washer filtrate was added as counter-current wash liquid As can be seen from FIG 21., although the DOM concentration is initially reduced in the cooking zone, the DOM concentration is greater in the counter-current stage. Therefore, little improvement in DOM concentration is provided with this form of extended co-current cooking (276). While the computer model does have some limitations, FIG. 21 does show that DOM concentration can be varied throughout the cook.

Figure 22:
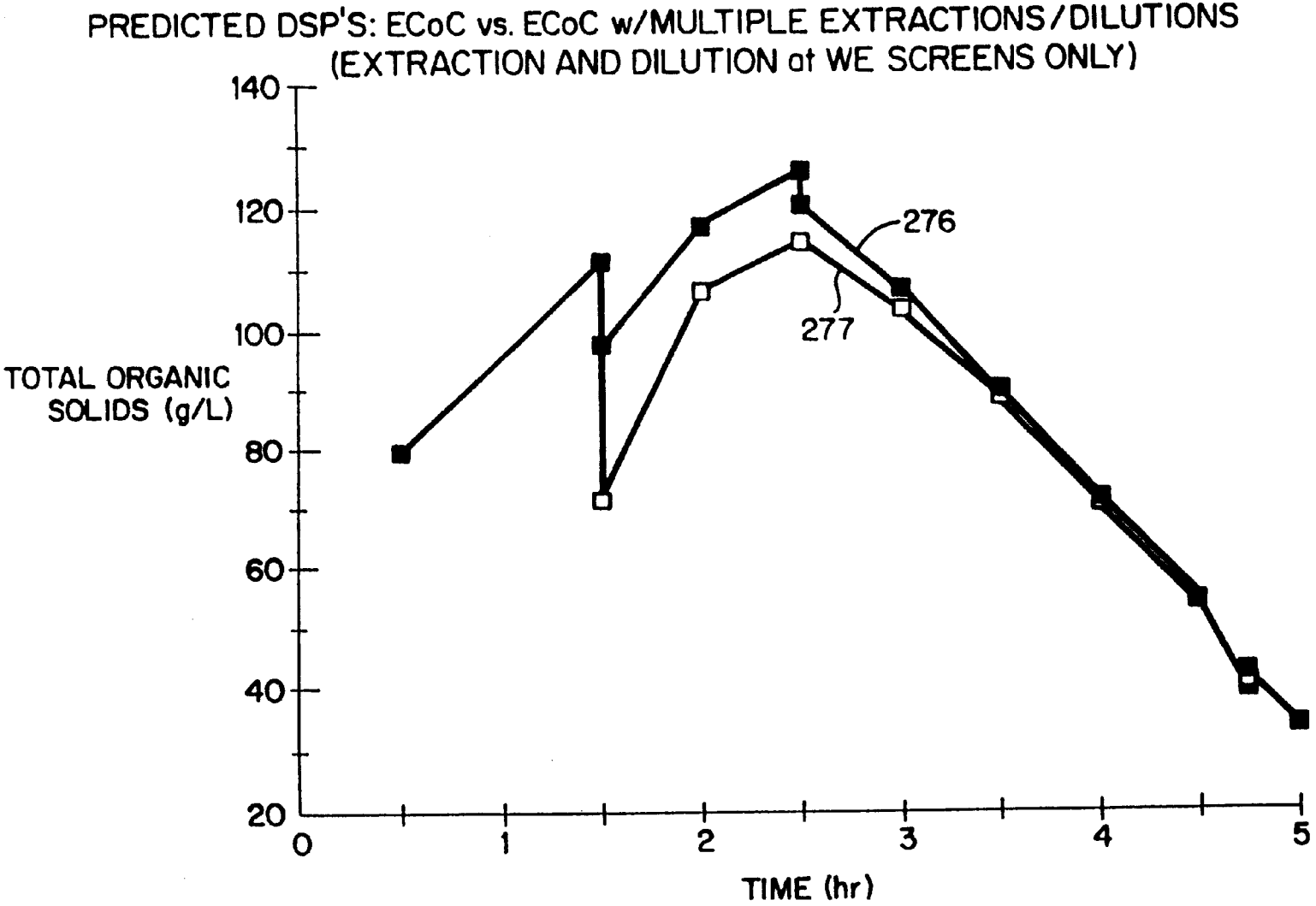

FIG. 22 illustrates the theoretical effect of adding white liquor at 201 and low DOM dilution liquor at 202 in FIG. 19. In FIG. 22, 1.0 tons of liquor per ton of pulp washer filtrate is added at 202, along with 0.6 t/tp white liquor. A corresponding liquor flow of 1.6 t/tp is extracted at 200. As seen by graph line 277, compared to graph line 276 of FIG. 21, the resulting DOM concentration drops dramatically between the screens 196, 206.

Figure 23:
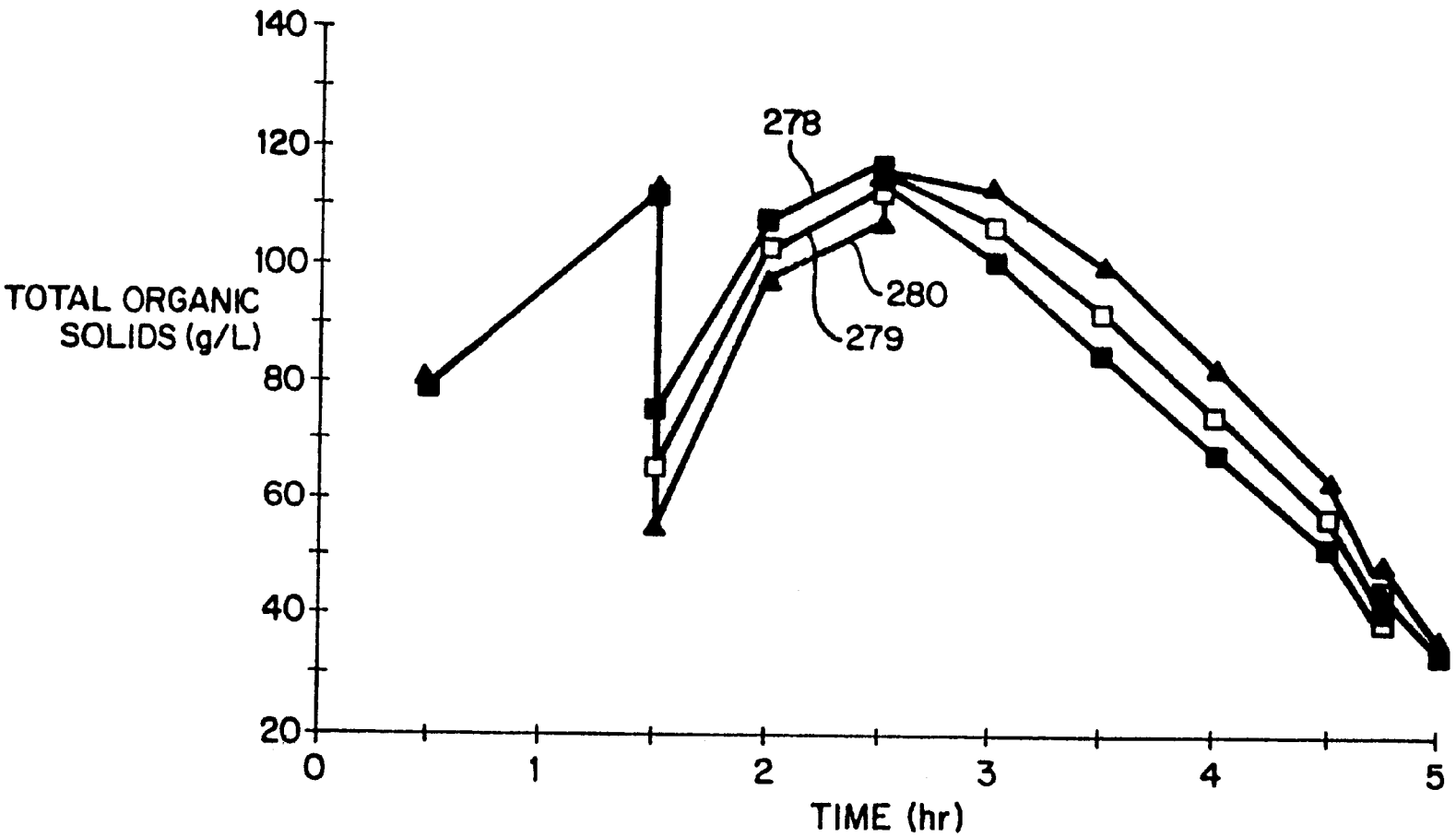

FIG. 23 shows the effect of varying the distribution of washer filtrate to dilution at 202 and 213. In this case the total washer filtrate of 1.5+1.0=2.5 t/tp is distributed at 213 and at 202. Graph line 278 shows a simulation for ⅓ of the dilution liquor being added at 202; 279, ½ at 202; and 280, ⅔ at 202 (the rest at 213 in each case). Thus, it is clear that DOM profile varies significantly with varying dilution flow, and the more dilution is added to the cooking zone, the more the DOM decreases there (though increasing in the wash zone).

Figure 24:
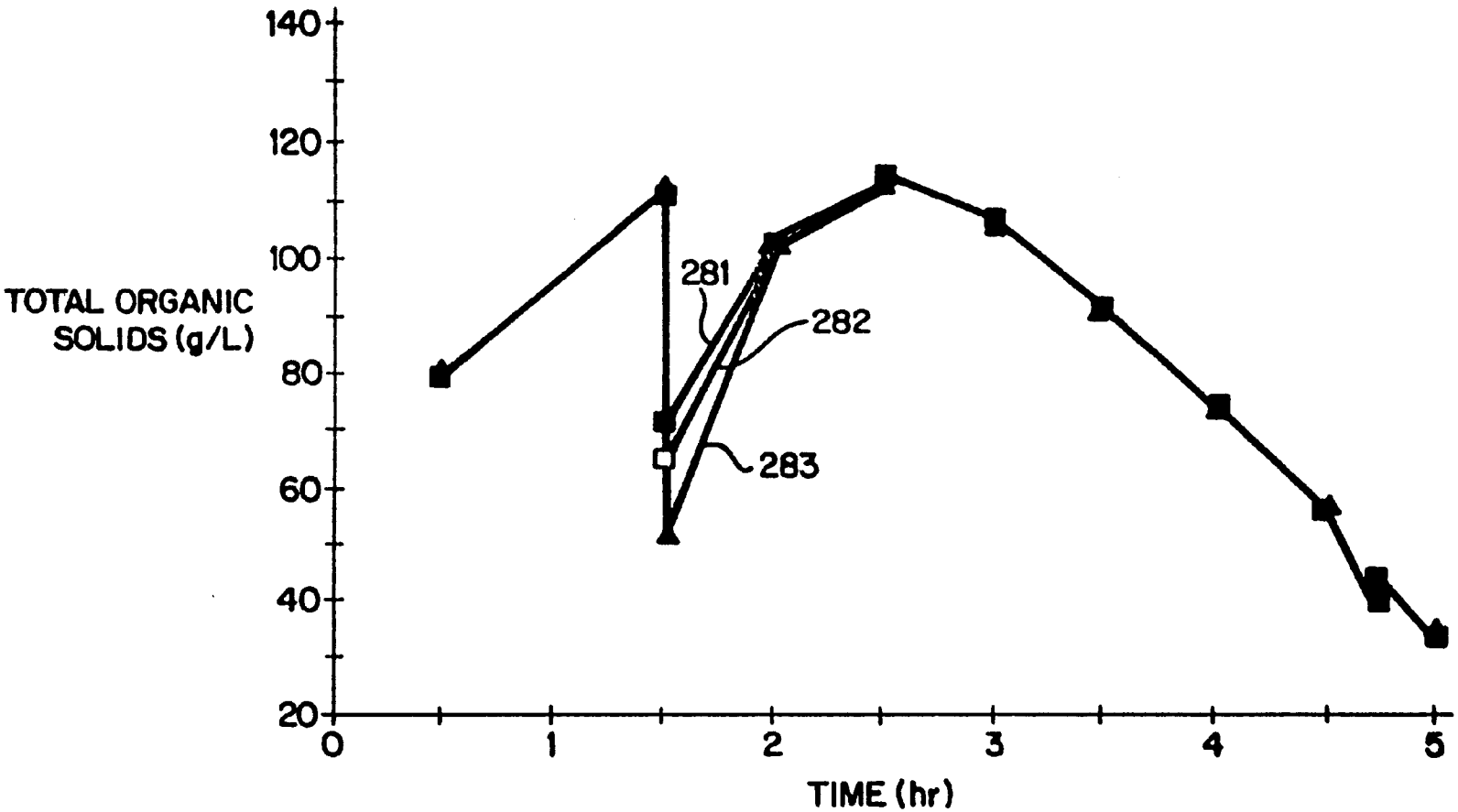

FIG. 24 illustrates the theoretical effect of varying the extraction at 200. Graph line 281 predicts the DOM profile where the extraction at 200 is 1.35 t/tp; line 282, where the extraction at 200 is 1.85 t/tp; and line 283, where the extraction at 200 is 2.6 t/tp. In each case the total 2.5 t/tp dilution is split evenly between 202 and 213, and an additional 0.6 t/tp white liquor is added at 201. FIG. 24 clearly shows that the theoretical DOM concentration in the cooking zone decrease with increased extraction at 200, and is essentially unchanged throughout the counter-current zone. Therefore, this extraction can be varied to accommodate extraction-screen pressure drop without affecting the DOM profile very much.

Figure 25:
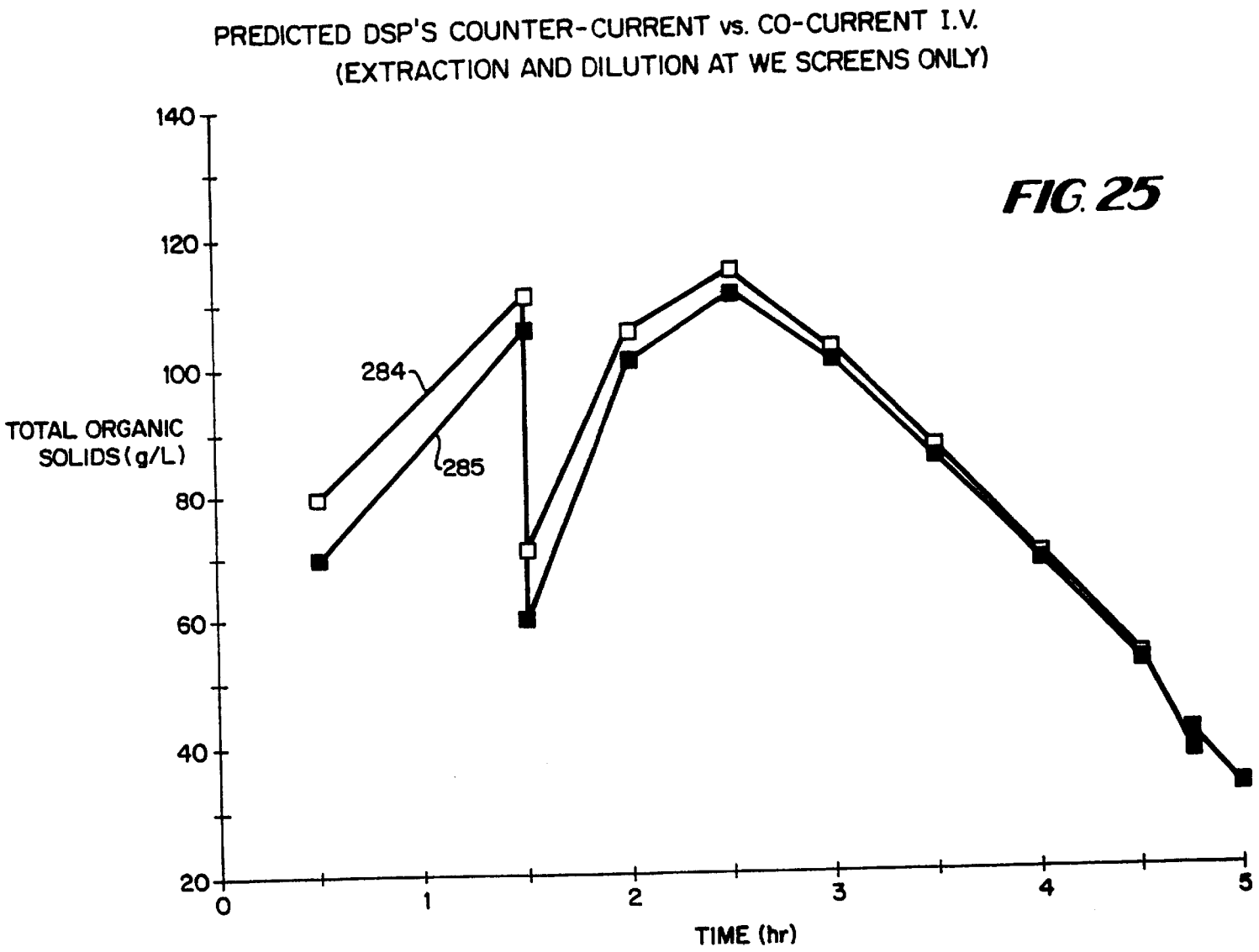

FIG. 25 shows the effect of extracting from 185 (the top of the impregnation vessel 180) to create a zone of counter-current impregnation while employing extended co-current cooking with dilution. In this case the reference co-current impregnation vessel data are identical to those shown in FIG. 22. The extraction flow 185 is 1.1 t/tp; the extracted liquor is not replaced by washer filtrate, but by white liquor at 184. In the previous models of FIGS. 21–24, 60% of the white liquor added was added at 184 and 5% at 214'; in FIG. 25, these are reversed, 5% at 184, and 60% at 214'. Graph line 284 shows the results for co-current impregnation vessel flow, while line 285 shows the results for counter-current flow (60% white liquor at 214'). Thus, this demonstrates that the theoretical DOM concentration decreases both in the vessel 180 and in the cooking zone, and is comparable in the counter-current cooking zone. Thus, lower DOM concentrations are possible due to extraction in the vessel 180 in addition to extraction and dilution in the digester 189.

It will thus be seen that according to the present invention, a method and apparatus have been provided which enhances the strength of kraft pulp by removing, minimizing (e.g. by dilution), or passifying DOM during any part of a kraft cook and/or enhancing other pulp or process parameters. While the invention has been herein shown and described in what is presently conceived to be the most practical and preferred embodiment thereof, it will be apparent to those of ordinary skill in the art that many modification may be made thereof within the scope of the invention, which scope is to be accorded the broadest interpretation of the appended claims so as to encompass all equivalent structures, methods, and products.

What is claimed is:

1. A method of producing kraft pulp by cooking comminuted cellulosic fibrous material comprising the steps of, during at least one stage during kraft cooking of the material to produce pulp and liquor surrounding the pulp which contains effective dissolved organic material:

(a) extracting liquor containing a level of dissolved organic material significant enough to adversely affect the H factor; and (b) replacing some or all of the extracted liquor with liquor containing a substantially lower effective dissolved organic material level than the extracted liquor, so as to significantly reduce the H factor; and wherein steps (a) and (b) are practiced to keep the effective dissolved organic material concentration at 100 g/l or less during substantially the entire kraft cook.

2. A method as recited in claim 1 wherein step (b) is practiced by replacing the extracted liquor with liquor selected from the group consisting essentially of water, substantially dissolved organic material free white liquor, pressure-heat treated black liquor, filtrate, and combinations thereof.

3. A method as recited in claim 1 wherein steps (a) and (b) are practiced to decrease the H factor by at least about 5% to achieve a given Kappa number.

4. A method as recited in claim 3 wherein steps (a) and (b) are practiced to keep the effective dissolved organic material concentration at about 50 g/l or less during the majority of the kraft cook.

5. A method as recited in claim 1 wherein steps (a) and (b) are further practiced to keep the effective dissolved hemicellulose concentration of the cooking liquor at 15 g/l or less throughout substantially the entire kraft cook.

6. A method as recited in 1 wherein steps (a) and (b) are practiced to keep the effective dissolved organic material concentration at about 50 g/l; or less during the majority of the kraft cook.

7. A method as recited in claim 1 wherein steps (a) and (b) are further practiced to keep the effective dissolved lignin concentration at about 25 g/l or less throughout substantially the entire kraft cook.

8. A method as recited in claim 1 wherein steps (a) and (b) are practiced to keep the effective dissolved hemicellulose concentration at about 10 g/l or less throughout the majority of the kraft cook.

9. A method as recited in claim 1 wherein the kraft cooking is performed in one or more batch digesters.

10. A method as recited in 1 wherein the kraft cooking is performed in one or more continuous digester vessels.

11. A method of continuously producing chemical cellulose pulp using at least first and second screen assemblies in a digester, spaced from each other in a first direction, comprising the steps of continuously:

(a) passing a liquid slurry of comminuted cellulosic fibrous material in the first direction to and past the first screen assembly, the slurry having a first level of dissolved organic material therein;

(b) withdrawing liquid, having the first level of dissolved organic material, from the slurry at the first screen assembly, and passing at least some of the withdrawn liquor to recovery or other handling outside the digester;

(c) after steps (a) and (b) passing the slurry in the first direction to and past the second screen assembly;

(d) at the second screen assembly withdrawing and recirculating in a recirculation loop, back to the digester slurry liquid;

(e) introducing cooking liquor into the recirculation loop;

(f) introducing dilution liquid, having a second level of dissolved organic material significantly enough less than the first level to positively affect pulp strength, effective alkali consumed, H-factor, or bleachability, into the recirculation loop; and (g) introducing the liquid in the recirculation loop back into the digester so that the liquid introduced from the recirculation loop has a third level of dissolved organic material therein significantly enough less than the first level to positively affect pulp strength, effective alkali consumed, H-factor, or bleachability.

12. A method as recited in claim 11 wherein step (g) further comprises heating the liquid in the recirculation loop prior to returning the heated liquid to the digester.

13. A method of producing kraft pulp by cooking comminuted cellulosic fibrous material comprising the steps of, during at least one stage during kraft cooking of the material to produce pulp and liquor surrounding the pulp which contains effective dissolved organic material:

(a) extracting liquor containing a level of dissolved organic material significant enough to adversely affect the amount of effective alkali consumed; and (b) replacing some or all of the extracted liquor with liquor containing a substantially lower effective dissolved organic material level than the extracted liquor, so as to significantly reduce the effective alkali consumed; and wherein steps (a) and (b) are practiced to keep the effective dissolved organic material concentration at 100 g/l or less during substantially the entire kraft cook.

14. A method as recited in claim 13 wherein (a) and (b) are practed to decrease the amount of effective alkali consumed by at least 0.5% on wood to achieve a given Kappa number.

15. A method as recited in claim 14 wherein (a) and (b) are practiced to keep the effective dissolved organic material concentration at about 50 g/l or less during substantially the majority of the kraft cook.

16. A method as recited in claim 13 wherein (a) and (b) are practiced to decrease the amount of effective alkali consumed by about 4% on wood to achieve a given Kappa number.

17. A method of producing kraft pulp by cooking comminuted cellolosic fibrous material comprising the steps of, during at least one stage during kraft cooking of the material to produce pulp and liquor surrounding the pulp which contains effective dissolved organic material;

(a) extracting liquor containing a level of dissolved organic material significant enough to adversely affect bleachability; and (b) replacing some or all of the extracted liquor with liquor containing a substantially lower effective dissolved organic material level than the extracted liquor, so as to significantly increase bleachability; and wherein steps (a) and (b) are practiced to keep the effective dissolved organic material concentration at 100 g/l or less during substantially the entire kraft cook.

18. A method as recited in claim 17 wherein (a) and (b) are practiced to increase ISO brightness by at least one unit at a particular full sequence Kappa factor, or to maintain brightness and reduce Kappa factor.

19. A method as recited in claim 18 wherein (a) and (b) are practiced to keep the effective dissolved organic material concentration at about 50 g/l or less during substantially the majority of the kraft cook.

* * * * *